US006370990B1

(12) United States Patent
Lin

(10) Patent No.: US 6,370,990 B1
(45) Date of Patent: Apr. 16, 2002

(54) HANDLE STRUCTURE FOR ADJUSTING THE ARM OF FORCE OF A TOOL

(75) Inventor: Chorng-Jiang Lin, Taichang (TW)

(73) Assignee: Chuck (Chen-Tsai) Chang, Taichang (TW)

( * ) Notice: Subject to any disclaimer, the term of this patent is extended or adjusted under 35 U.S.C. 154(b) by 0 days.

(21) Appl. No.: 09/512,072

(22) Filed: Feb. 24, 2000

(51) Int. Cl.[7] ..... B25B 23/16
(52) U.S. Cl. ..... 81/177.2; 81/177.85
(58) Field of Search ..... 81/177.1, 177.2, 81/177.85; 403/108, 109, 377–379; 16/115

(56) References Cited

U.S. PATENT DOCUMENTS 4,409,866 A * 10/1983 McBride ..... 81/117.2
5,099,724 A * 3/1992 Reddy, Jr. ..... 81/177.2 X
5,396,820 A * 3/1995 Baker ..... 81/177.2
5,931,065 A * 8/1999 Jackson et al. ..... 81/177.2
6,058,814 A * 5/2000 Johnson ..... 81/177.2
6,092,442 A * 7/2000 Macor ..... 81/177.2 X

* cited by examiner

*Primary Examiner*—D. S. Meislin
(74) *Attorney, Agent, or Firm*—Rosenberg, Klein & Lee

(57) ABSTRACT

A handle structure for a tool includes a handle body slidably secured on the shank of the tool for adjusting an arm of force of the shank of the tool. The handle structure also includes a retaining device mounted between the handle body and the shank of the tool for retaining the handle body on the shank of the tool, and a restoring device mounted between the handle body and the shank of the tool so that the handle body can slide on the shank of the tool.

3 Claims, 35 Drawing Sheets

HANDLE STRUCTURE FOR ADJUSTING THE ARM OF FORCE OF A TOOL

BACKGROUND OF THE INVENTION

1. Field of the Invention

The present invention relates to a handle structure for a tool, and more particularly to a handle structure for adjusting the arm of force of a tool.

2. Description of the Related Art

A first conventional tool 60 in accordance with the prior art shown in FIGS. 32 and 33 comprises a shank 61, a driving head 62 formed on a first end of the shank 61, and a handle 66 mounted on a second end of the shank 61. When a user exerts a force "F" on the handle 66 to rotate relative to the driving head 62 through a length of arc "S", the moment of force exerted by the handle 66 of the tool 60 is equal to F×L. However, the moment of force exerted by the handle 66 of the tool 60 is fixed and cannot be adjusted, thereby limiting the versatility of the handle 66, and thereby consuming the user's energy.

A second conventional tool 80 in accordance with the prior art shown in FIGS. 34 and 35 comprises a shank 81 having two distal ends each formed with a driving head 82, and a handle 86 mounted on a mediate portion of the shank 81. However, the moment of force exerted by the handle 86 of the tool 80 is fixed and cannot be adjusted, thereby limiting the versatility of the handle 86, and thereby consuming the user's energy.

SUMMARY OF THE INVENTION

In accordance with one aspect of the present invention, there is provided a handle structure for a tool comprising a handle body slidably secured on the shank of the tool for adjusting an arm of force of the shank of the tool. The handle body has a slide channel defined therein for receiving the shank of the tool.

The handle structure further comprises a retaining device mounted between the handle body and the shank of the tool for retaining the handle body on the shank of the tool, and a restoring device mounted between the handle body and the shank of the tool so that the handle body can slide on the shank of the tool.

Further benefits and advantages of the present invention will become apparent after a careful reading of the detailed description with appropriate reference to the accompanying drawings.

DETAILED DESCRIPTION OF THE INVENTION

Figure 1:
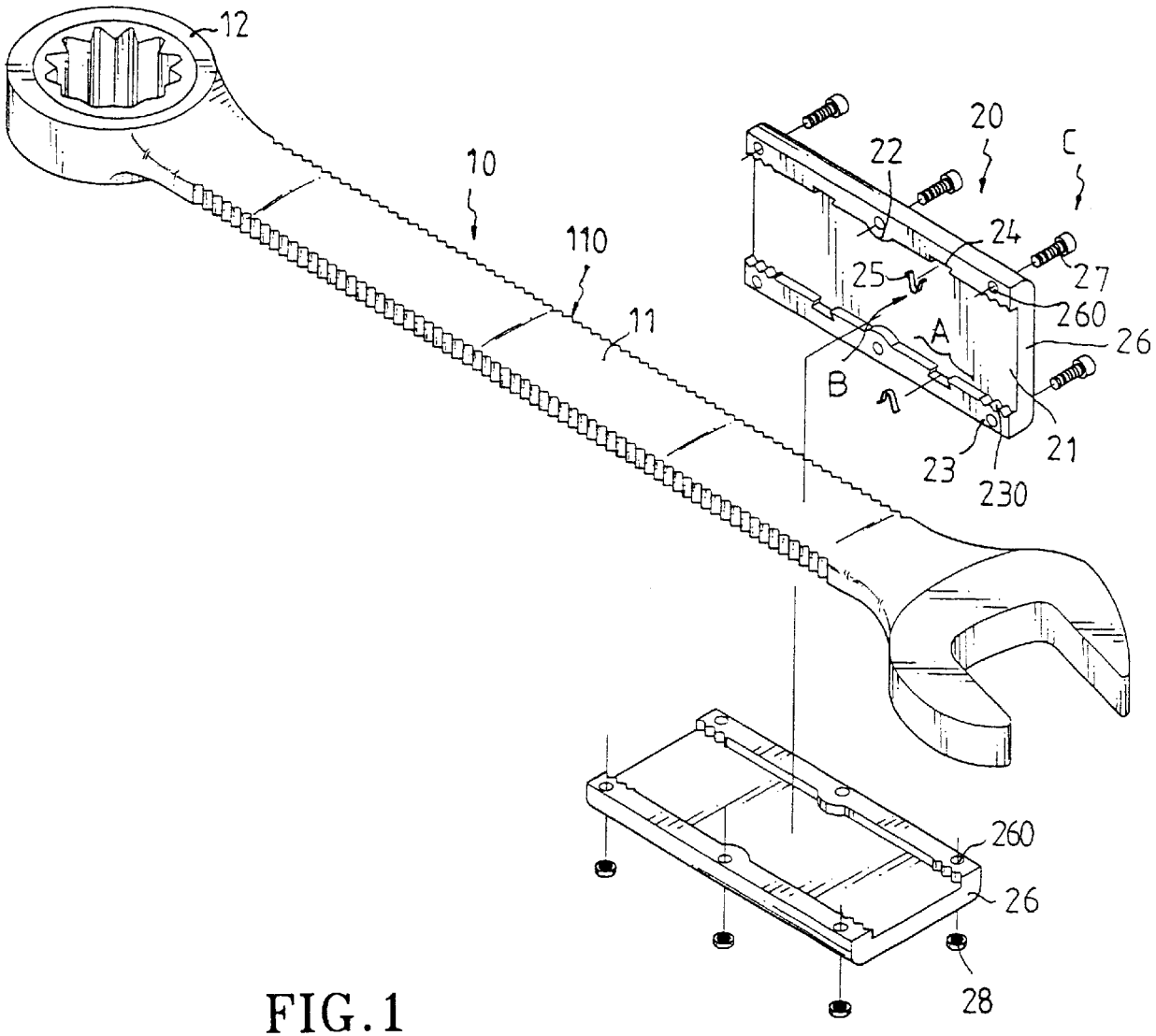
FIG. 1 is an exploded view of a handle structure for a tool in accordance with the present invention.
Figure 2:
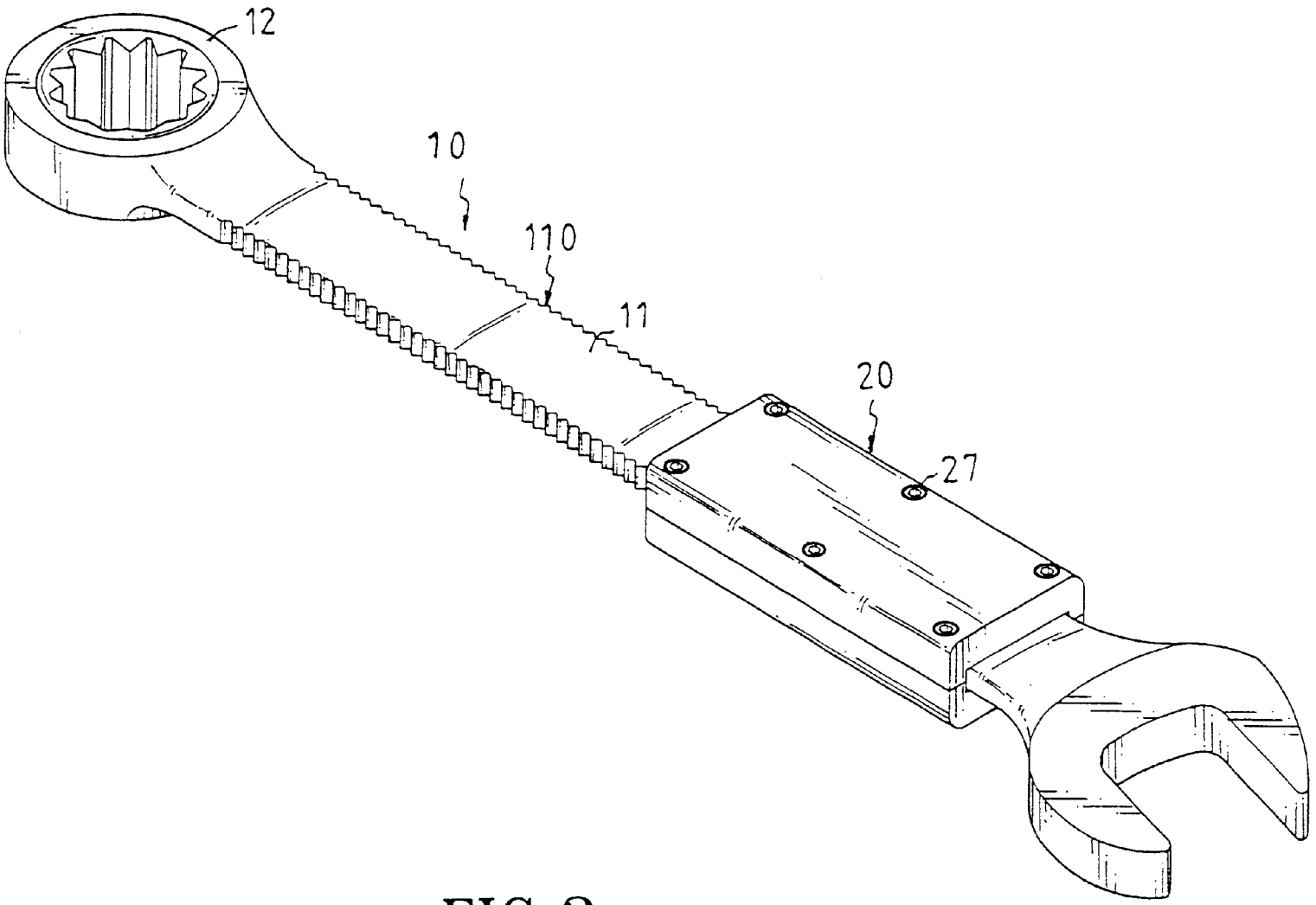
FIG. 2 is a perspective assembly view of the handle structure as shown in FIG. 1.

Referring to the drawings and initially to FIGS. 1–7, a handle structure in accordance with the present invention is used for a tool 10 such as a combination wrench or the like which includes a shank 11 and a driving head 12. The handle structure comprises a handle body 20 slidably secured on the shank 11 of the tool 10 for adjusting an arm of force of the shank 11 of the tool 10 and defining a slide channel 21 for receiving the shank 11 of the tool 10.

The handle structure further comprises a retaining device "A" mounted between the handle body 20 and the shank 11 of the tool 10 for retaining the handle body 20 on the shank 11 of the tool 10.

The shank 11 of the tool 10 has two sides, the slide channel 21 has two sides, and the retaining device "A" includes a support portion 22 mounted on each of the two sides of the slide channel 21, a tooth-shaped first positioning portion 110 mounted on each of the two sides of the shank 11 of the tool 10, and an anti-slip member 23 mounted on each of the two sides of the slide channel 21 and having a tooth-shaped second positioning portion 230 engaging with the first positioning portion 110.

The handle structure further comprises a restoring device "B" mounted between the handle body 20 and the shank 11 of the tool 10 so that the handle body 20 can slide on the shank 11 of the tool 10.

The restoring device "B" includes a receiving recess 24 defined in each of the two sides of the slide channel 21, and a flexible V-shaped restoring member 25 received in the receiving recess 24 and urged between the handle body 20 and the shank 11 of the tool 10.

The handle body 20 includes two half bodies 26 coupled with each other, and the handle structure further comprises a locking device "C" for securing the two half bodies 26 together.

Each of the two half bodies 26 has a plurality of through holes 260 defined therein, and the locking device "C" includes a plurality of locking bolts 27 each extending through a corresponding one of the through holes 260, and a plurality of engaging nuts 28 each engaged with a corresponding one of the locking bolts 27.

Figure 3:
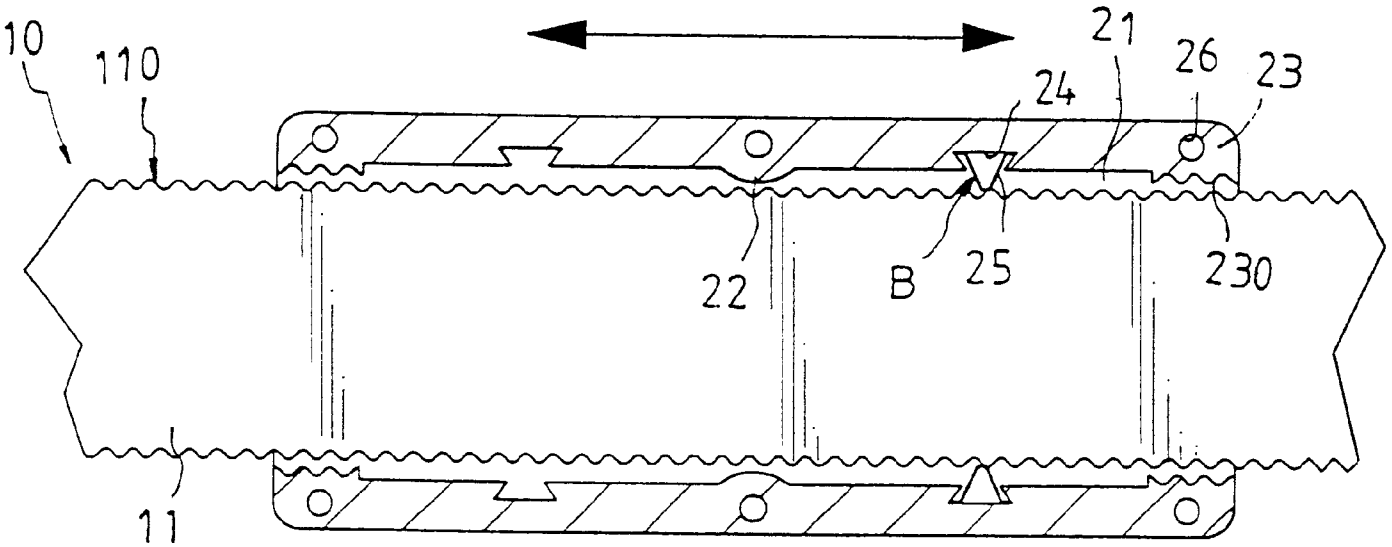
FIG. 3 is a top plan cross-sectional view of the handle structure as shown in FIG. 2.
Figure 4:
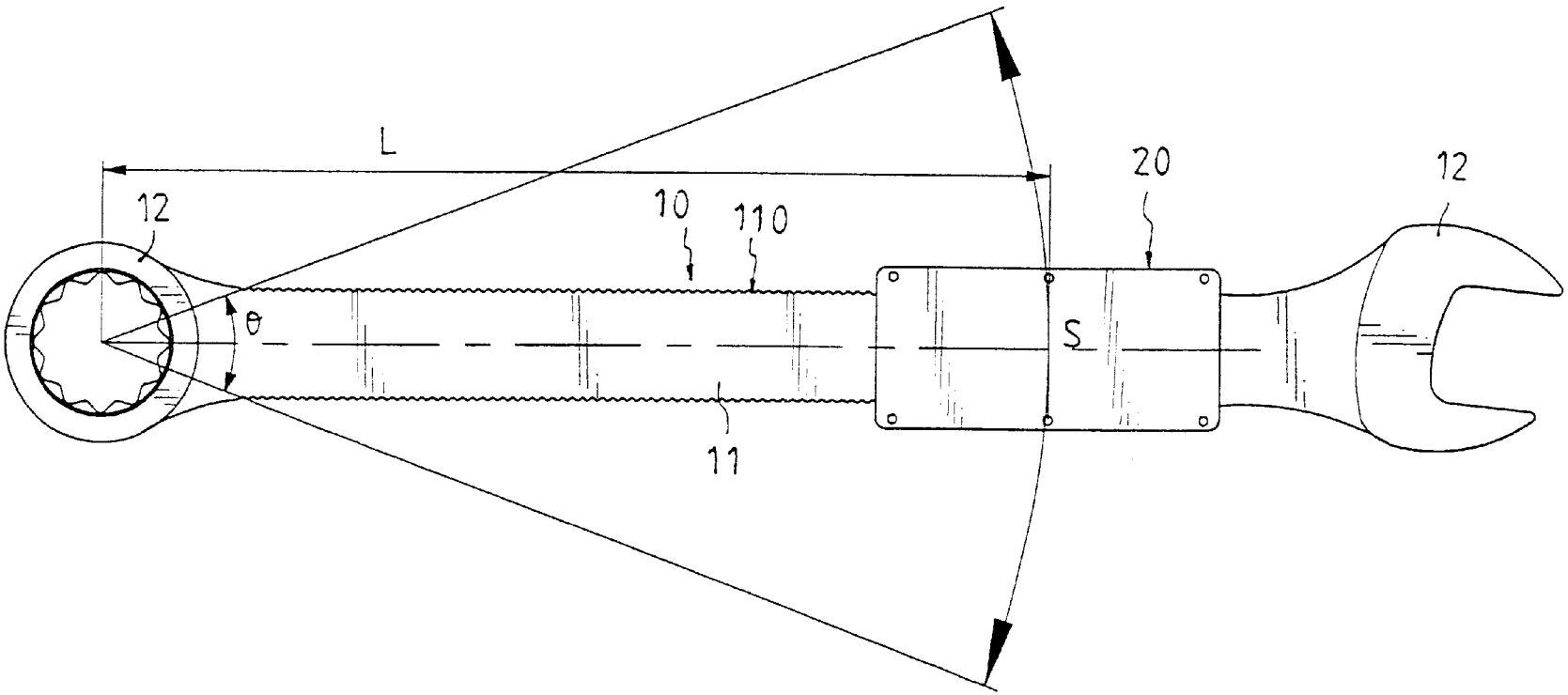
FIG. 4 is a top plan view of the handle structure as shown in FIG. 2.
Figure 5:
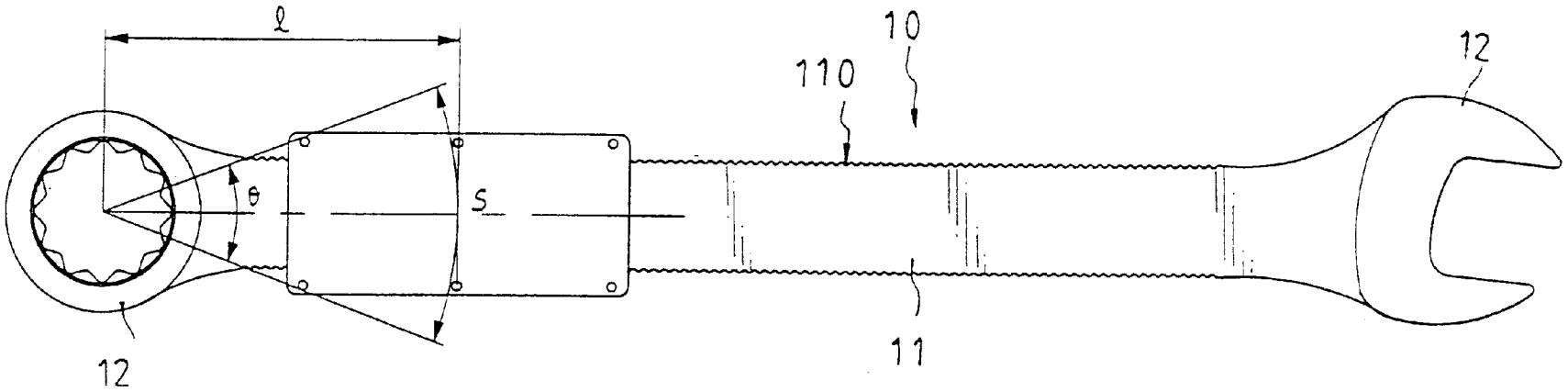
FIG. 5 is a top plan view of the handle structure as shown in FIG. 2.

In operation, when the user does not exert a force on the handle body 20, the handle body 20 holds the shank 11 of the tool 10 by means of the support portions 22 as shown in FIG. 3 so that the handle body 20 can be moved on the shank 11 of the tool 10 between the position as shown in FIG. 4 and the position as shown in FIG. 5, thereby arbitrarily adjusting the arm of force "L", the angle of rotation "θ" and the distance of travel "S" of the tool 10.

Figure 6:
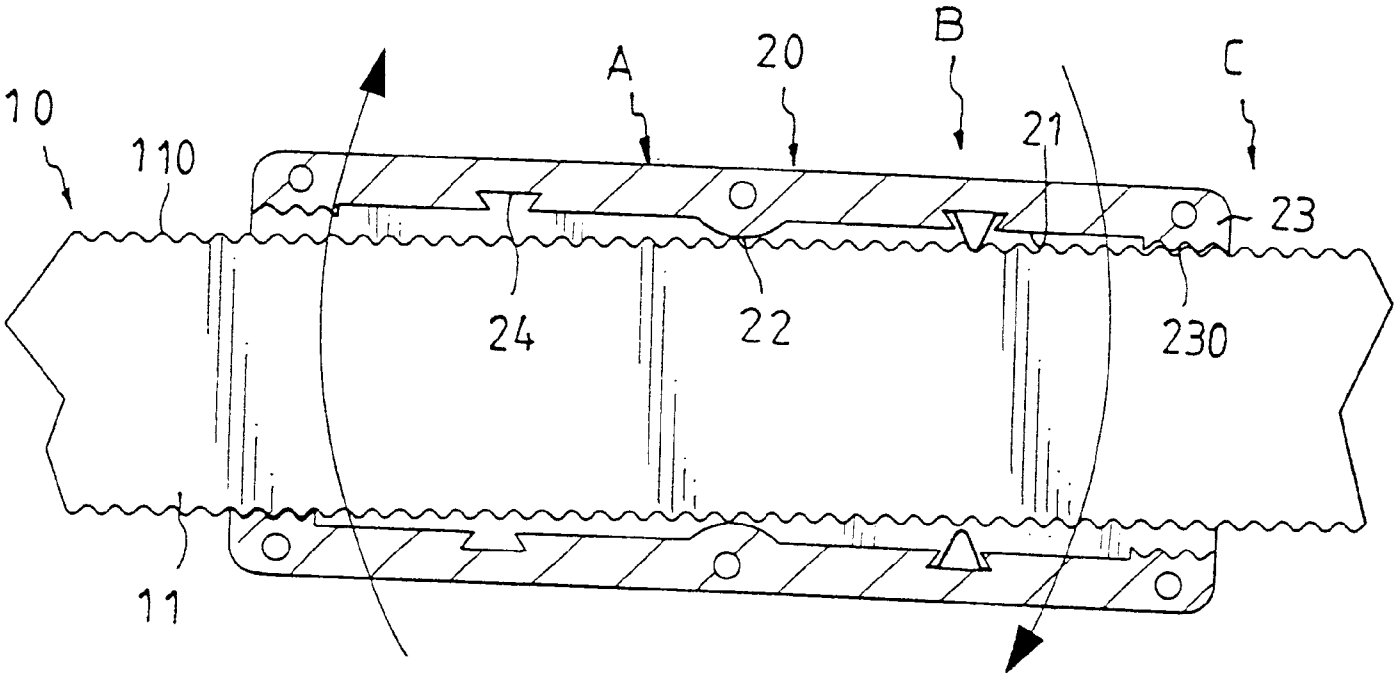
FIG. 6 is an operational view of the handle structure as shown in FIG. 3.
Figure 7:
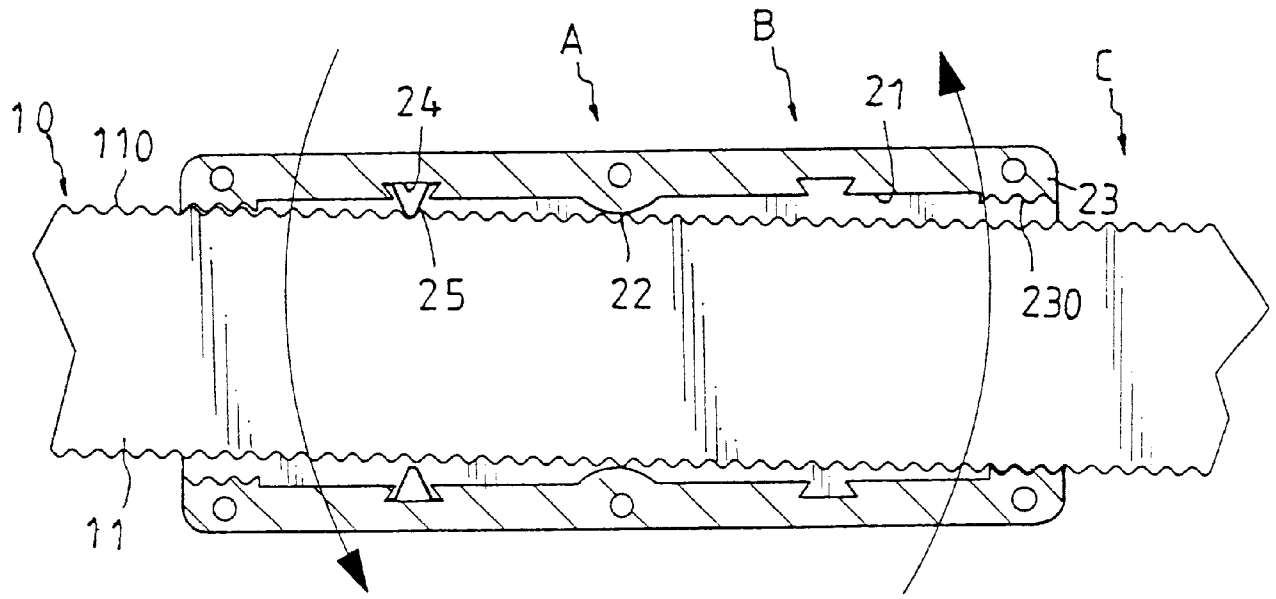
FIG. 7 is an operational view of the handle structure as shown in FIG. 3.

When the user exerts a force on the handle body 20, the handle body 20 is slightly rotated about the support portion 22 so that the positioning teeth 230 of the anti-slip member 23 engages with the positioning teeth 110 of the shank 11 of the tool 10 as shown in FIGS. 6 and 7, thereby securing the handle body 20 on the shank 11 of the tool 10.

When the force is removed, the handle body 20 is returned to its original position as shown in FIG. 3 by the restoring force of the restoring member 25.

Figure 8:
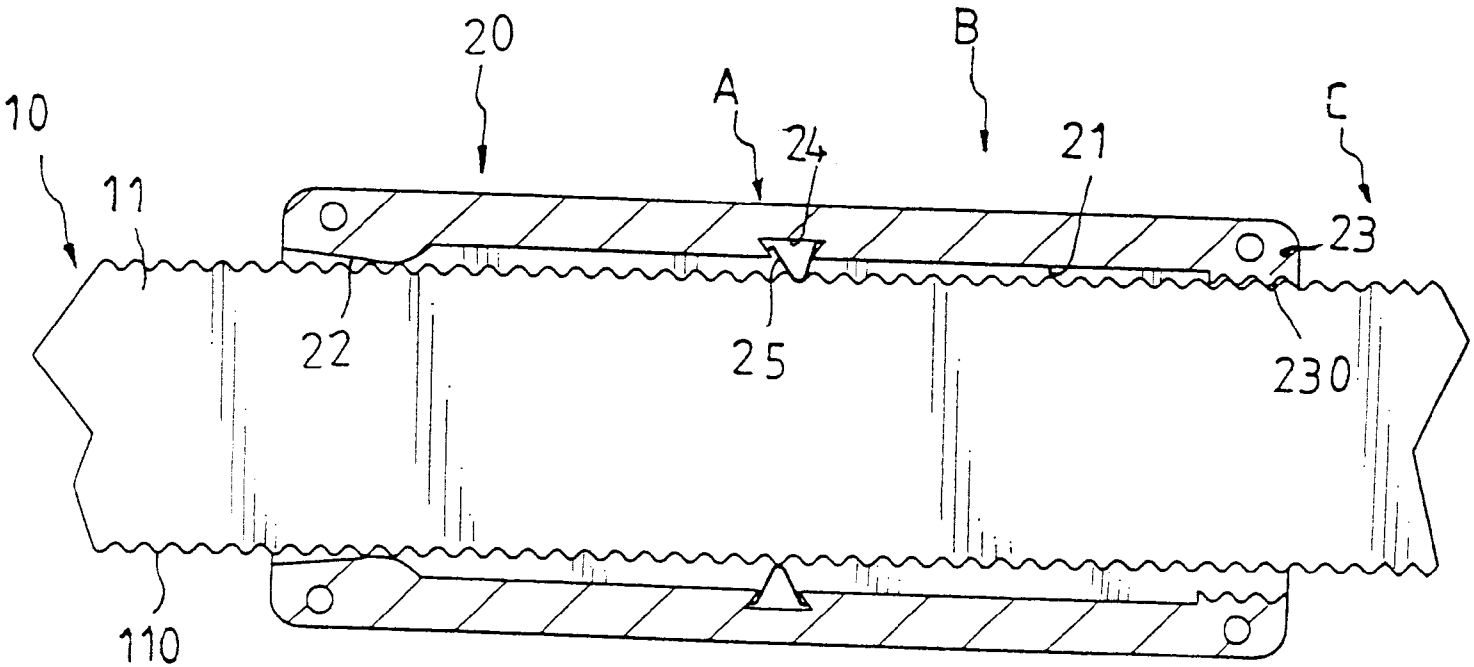
FIG. 8 is a top plan cross-sectional view of the handle structure according to another embodiment of the present invention.

Referring to FIG. 8, according to another embodiment of the present invention, the support portion 22 and the anti-slip member 23 are respectively formed on the two distal ends of the handle body 20, and the receiving recess 24 is located between the support portion 22 and the anti-slip member 23.

Figure 9:
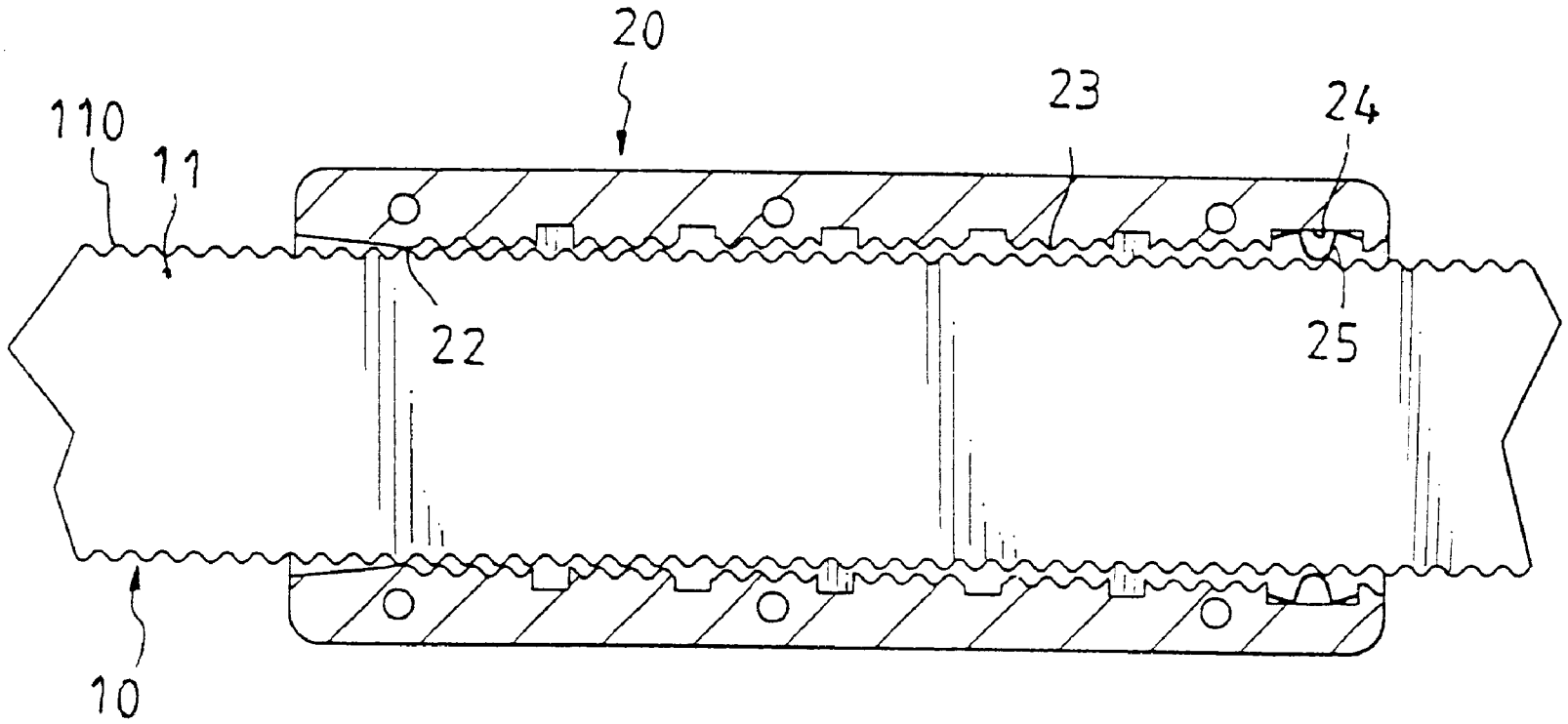
FIG. 9 is a top plan cross-sectional view of the handle structure according to a further embodiment of the present invention.

Referring to FIG. 9, according to a further embodiment of the present invention, the anti-slip members 23 and the receiving recesses 24 are serially arranged in the handle body 20.

Figure 10:
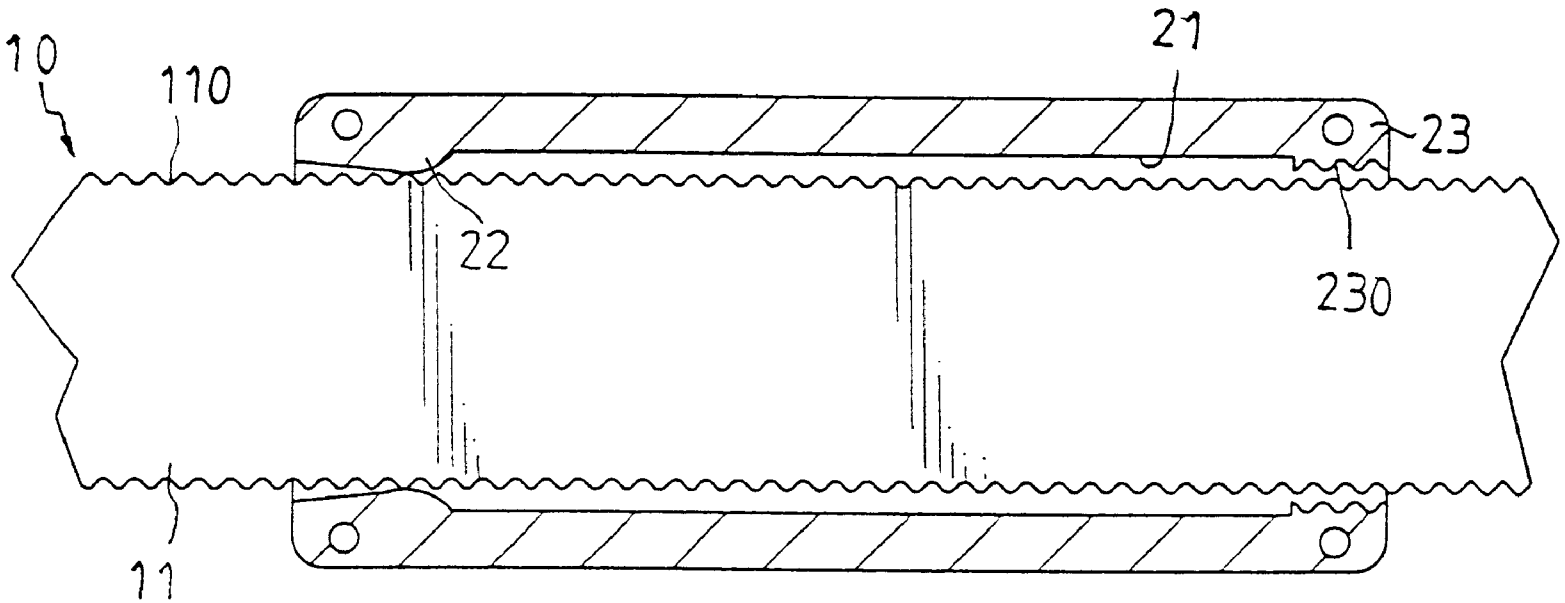
FIG. 10 is a top plan cross-sectional view of the handle structure according to a further embodiment of the present invention.

Referring to FIG. 10, according to a further embodiment of the present invention, the receiving recess 24 is undefined.

Figure 11:
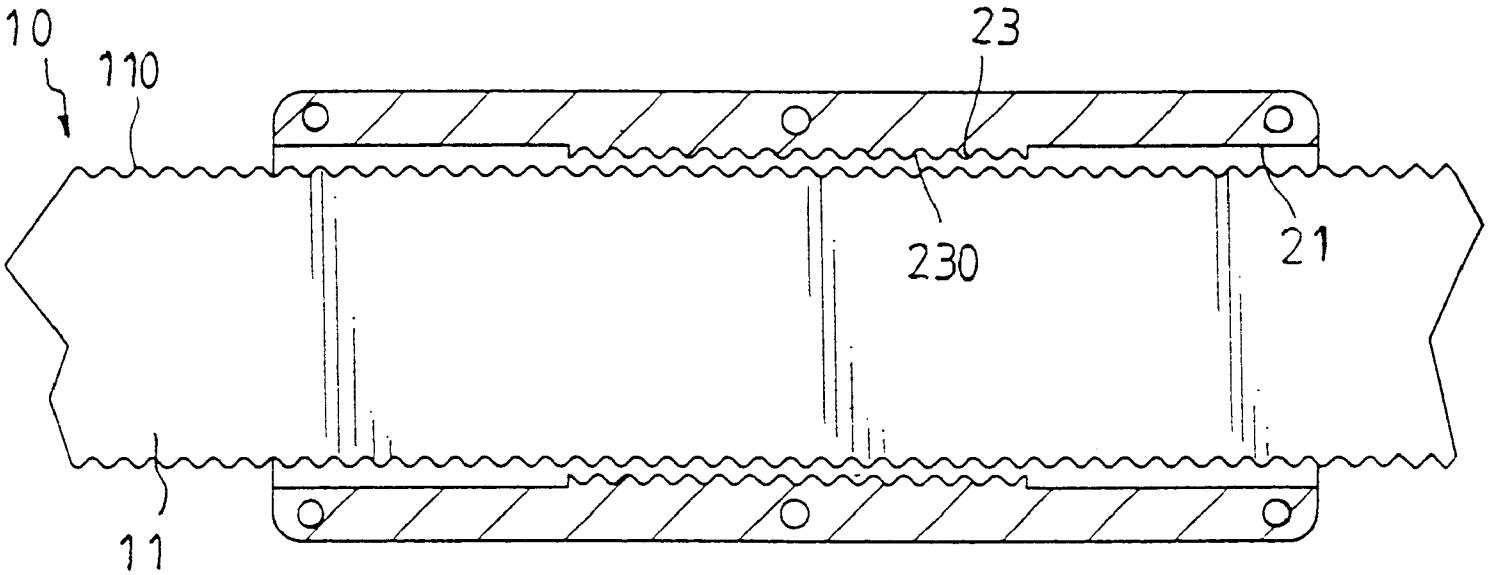
FIG. 11 is a top plan cross-sectional view of the handle structure according to a further embodiment of the present invention.

Referring to FIG. 11, according to a further embodiment of the present invention, the support portion 22 and the receiving recess 24 are undefined.

Figure 12:
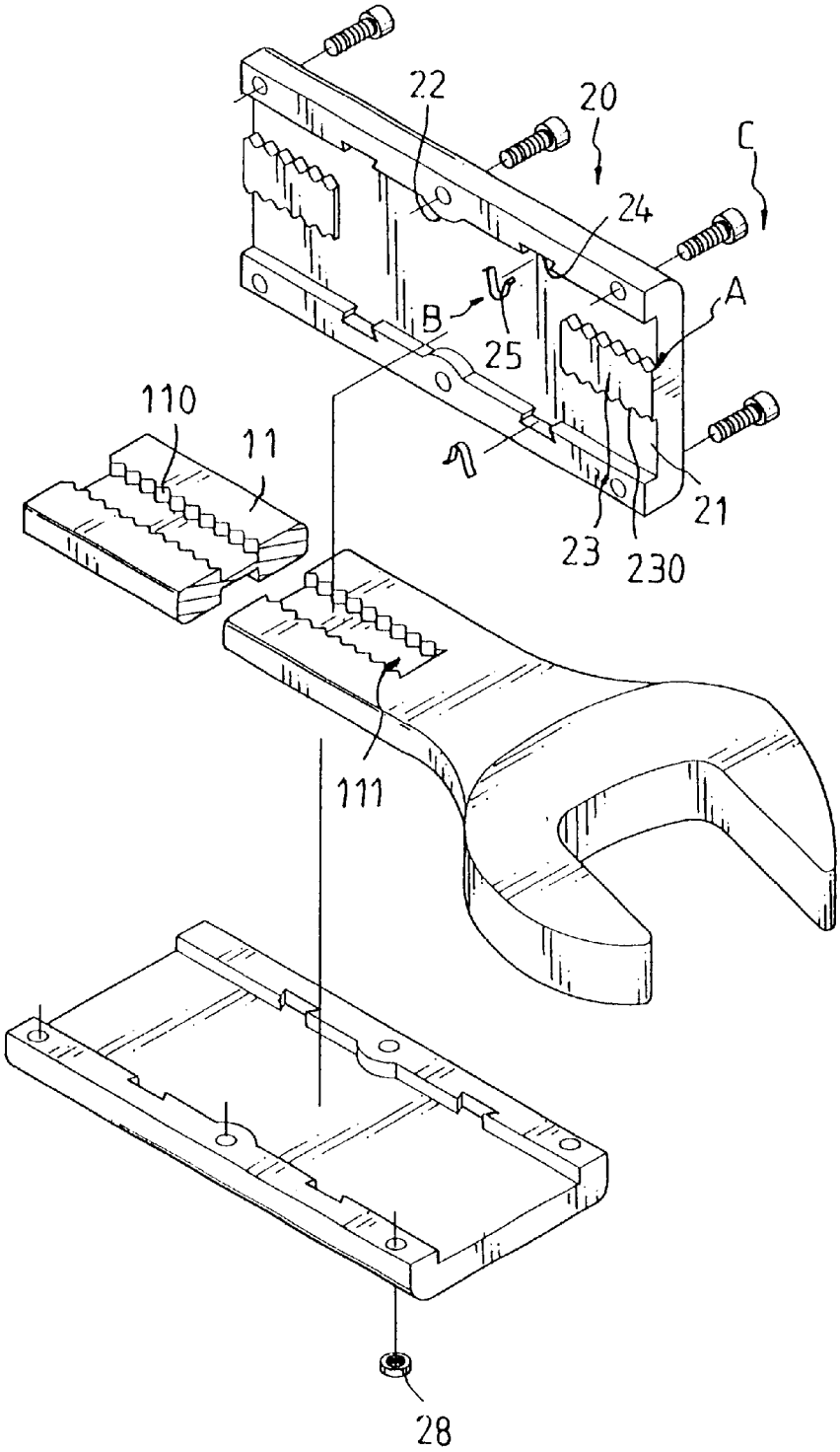
FIG. 12 is an exploded view of the handle structure according to a further embodiment of the present invention.

Referring to FIG. 12, according to a further embodiment of the present invention, the shank 11 of the tool 10 defines a retaining channel 111 having two sides, a tooth-shaped first positioning portion 110 mounted on each of the two sides of the retaining channel 111 of the shank 11 of the tool 10, and the retaining device "A" includes two anti-slip members 23 mounted in the slide channel 21 and each having two sides each including a tooth-shaped second positioning portion 230 engaging with the first positioning portion 110.

Figure 13:
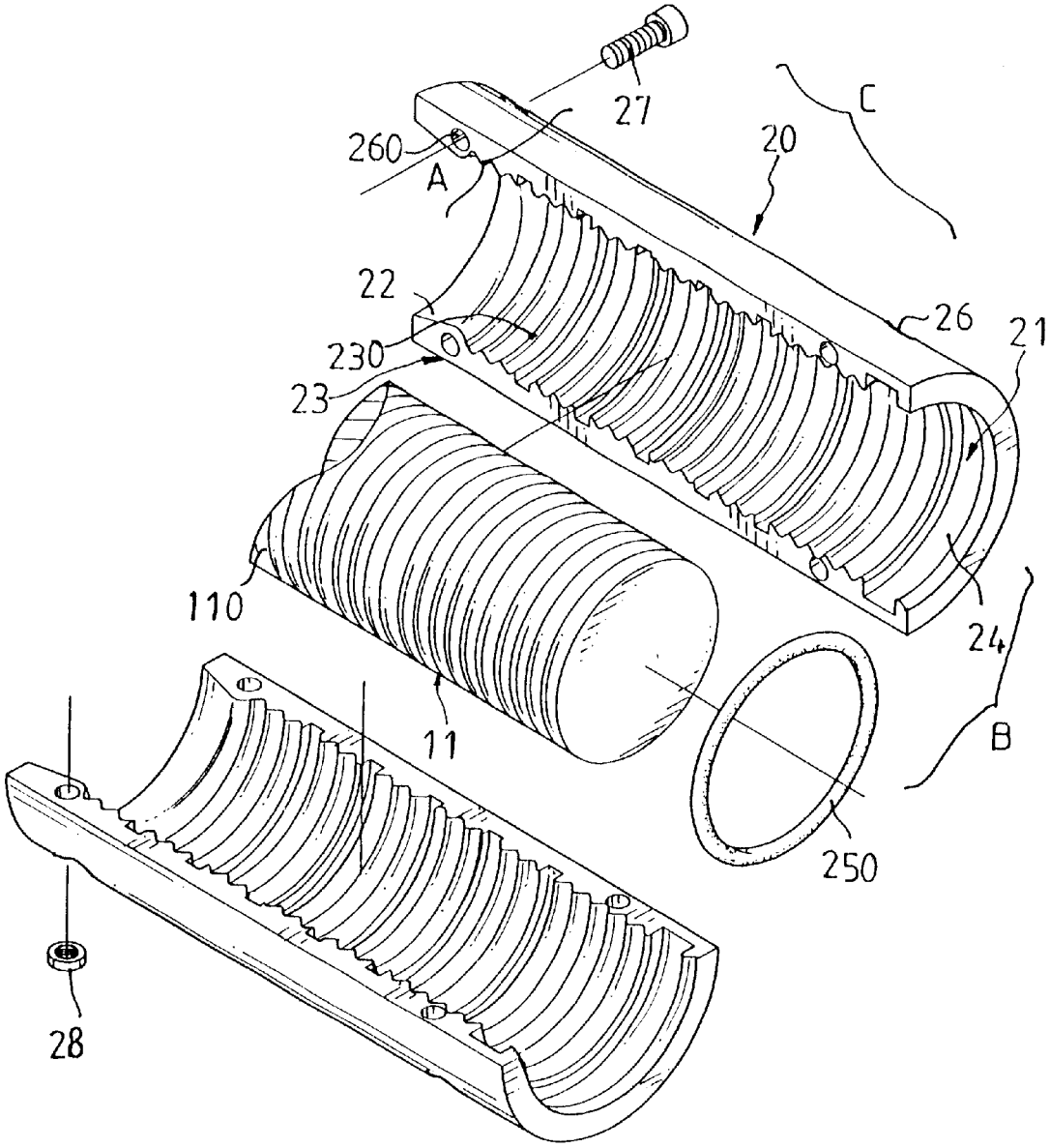
FIG. 13 is an exploded view of the handle structure according to a further embodiment of the present invention.
Figure 14:
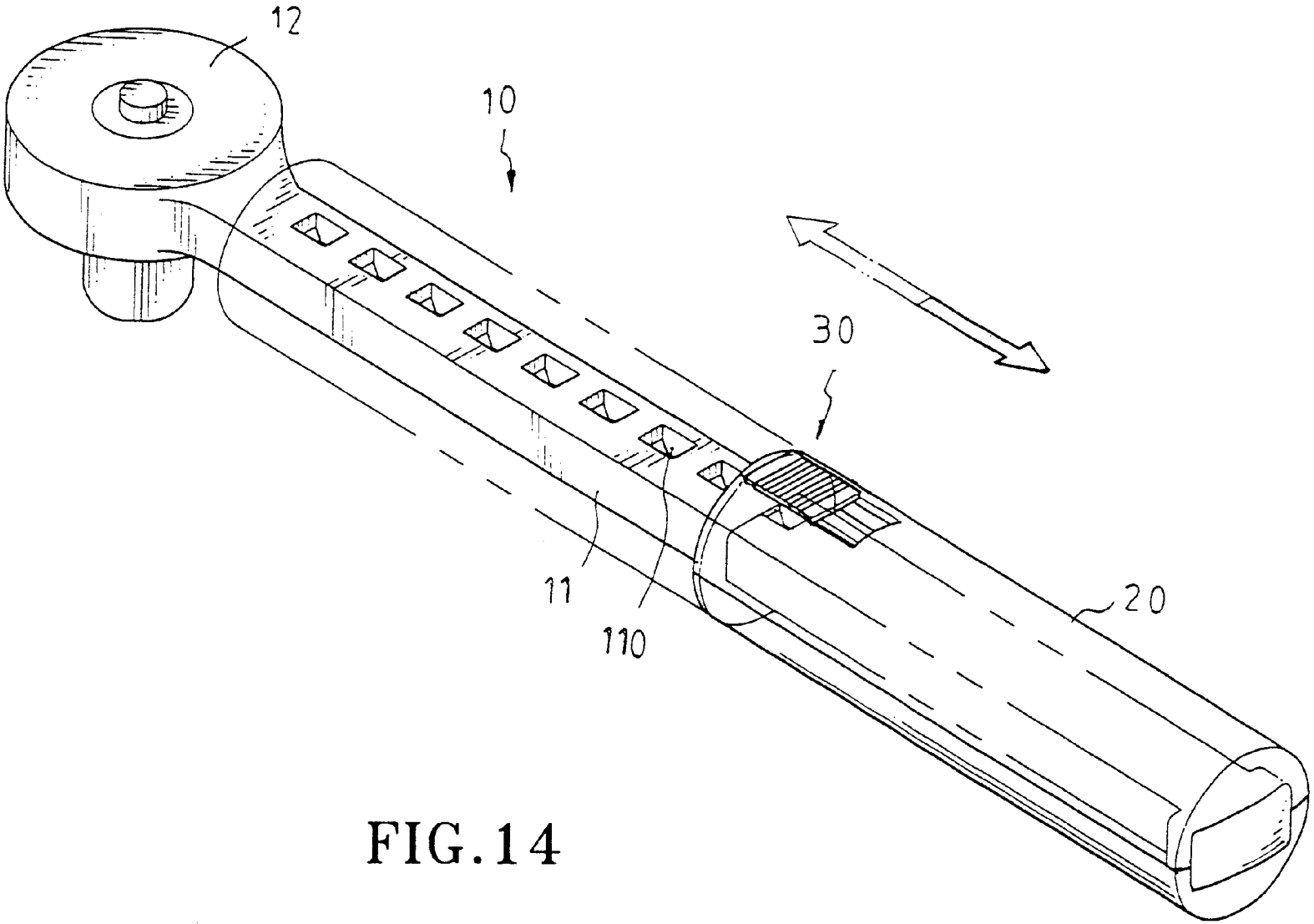
FIG. 14 is a perspective view of the handle structure according to a further embodiment of the present invention.
Figure 15:
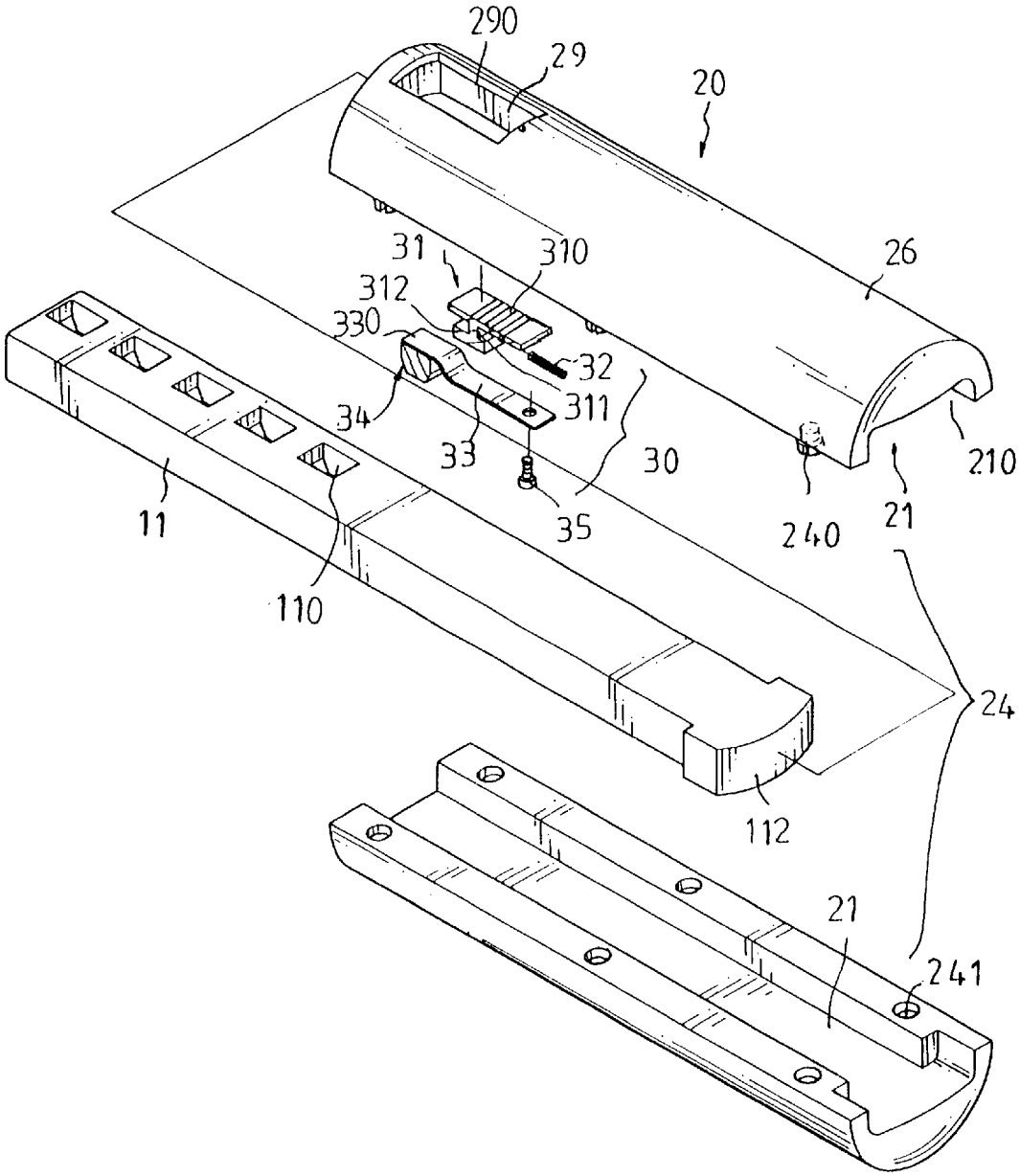
FIG. 15 is an exploded view of the handle structure as shown in FIG. 14.
Figure 16:
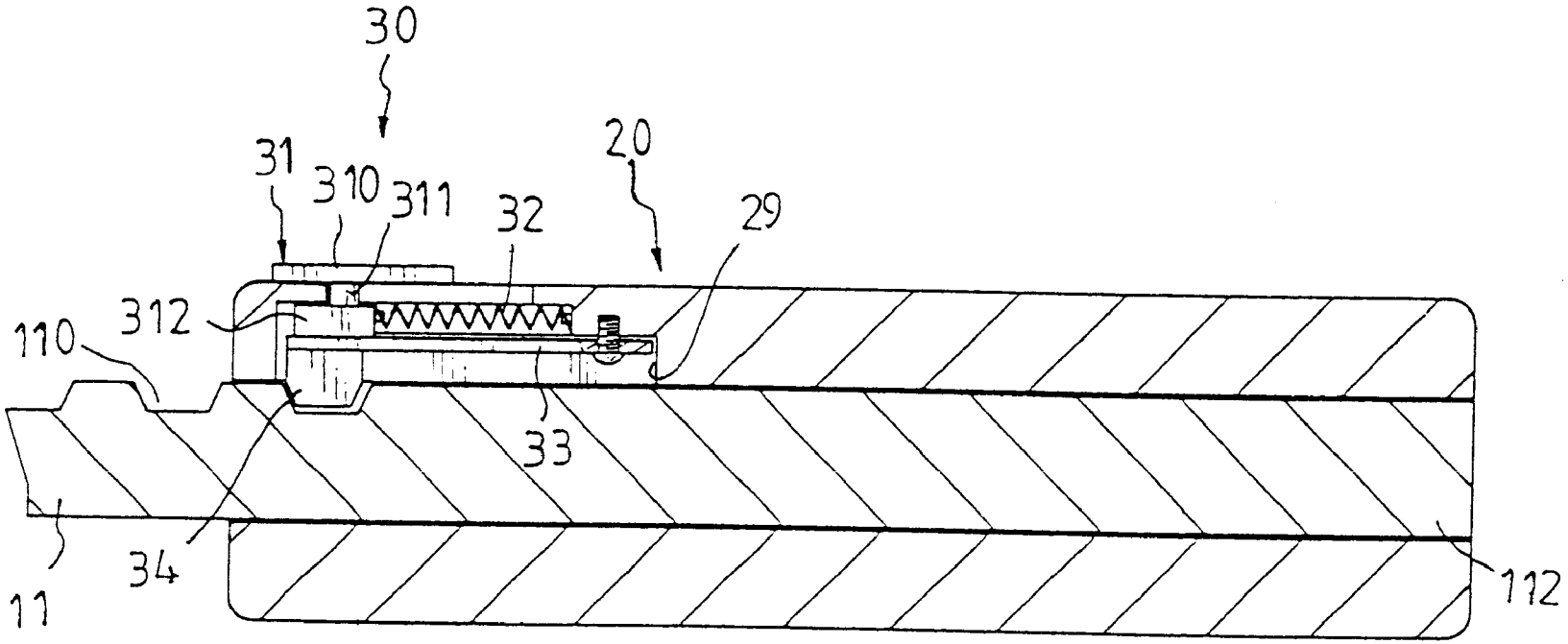
FIG. 16 is a front plan cross-sectional view of the handle structure as shown in FIG. 14.
Figure 17:
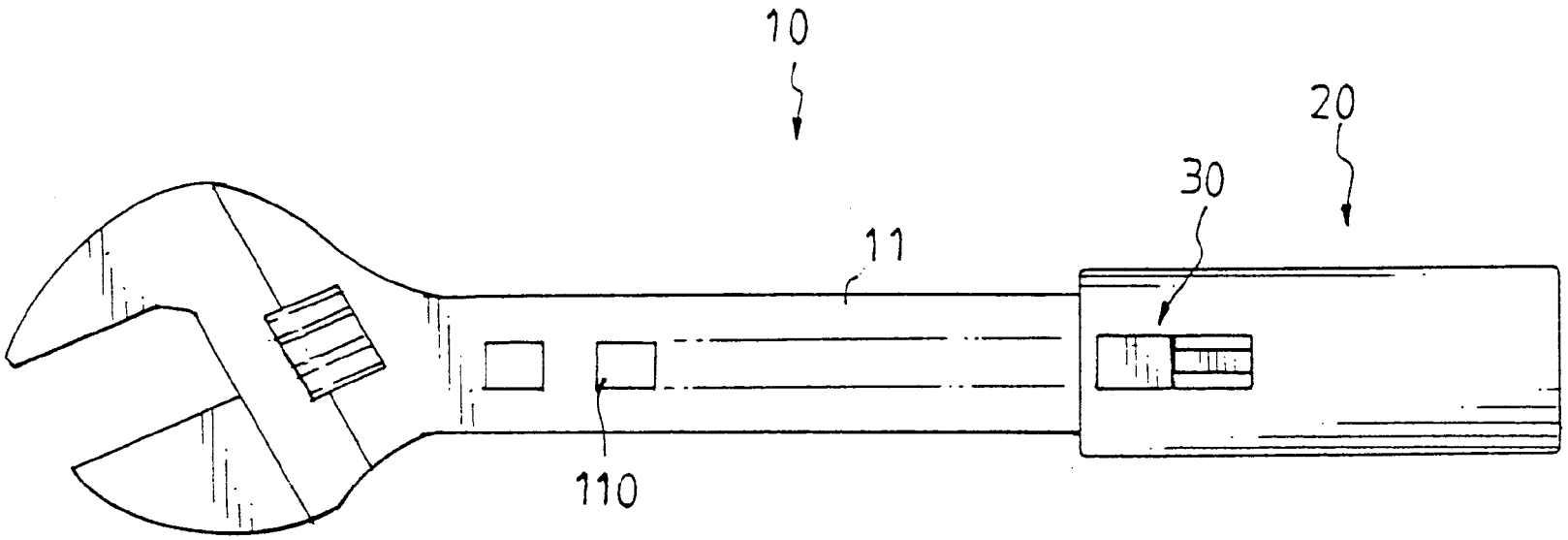
FIG. 17 is a top plan view of the handle structure.

Referring to FIG. 13, according to a further embodiment of the present invention, the retaining device "A" includes an annular support portion 22 mounted in the slide channel 21, a plurality of annular first positioning portions 110 mounted on the shank 11 of the tool 10, and an anti-slip member 23 mounted in the slide channel 21 and having a plurality of annular second positioning portions 230 engaging with the first positioning portion 110. The restoring device "B" includes an annular receiving recess 24 defined in the slide channel 21, and a flexible O-shaped restoring member 250 received in the receiving recess 24 and urged between the handle body 20 and the shank 11 of the tool 10.

Referring to FIGS. 14–17, according to a further embodiment of the present invention, the shank 11 of the tool 10 defines a plurality of positioning recesses 110. The handle body 20 defines a receiving chamber 29 having two sides each including a pressing edge 290. The handle structure comprises a retaining device 30 mounted between the handle body 20 and the shank 11 of the tool 10 for retaining the handle body 20 on the shank 11 of the tool 10.

The retaining device 30 includes a restoring member 33 having a first end secured to the wall of the receiving chamber 29 by a screw 35 and a bent second end 330, a positioning block 34 secured on the second end 330 of the restoring member 33 and detachably engaged with the positioning recesses 110, and a control member 31 including a pushing plate 310 extending outward from the receiving chamber 29, a slide 311 mounted on the pushing plate 310 and slidably mounted in the pressing edge 290 of the receiving chamber 29, a pressing block 312 mounted on the slide 311 and being movable to press the second end 330 of the restoring member 33 so as to move the positioning block 34 downward to be received in one of the positioning recesses 110, and a biasing member 32 mounted between the pressing block 312 and the wall of the receiving chamber 29.

The handle structure comprises a locking device 24 for securing the two half bodies 26 together and including a plurality of locking bores 241 defined in a first one of the two half bodies 26 of the handle body 20, and a plurality of snapping stubs 240 mounted on a second one of the two half bodies 26 of the handle body 20 and each snapped into a corresponding one of the locking bores 241.

The handle body 20 has one distal end defining a limiting recess 210, and the shank 11 of the tool 10 has one distal end including an enlarged head 112 detachably received in the limiting recess 210.

Figure 18:
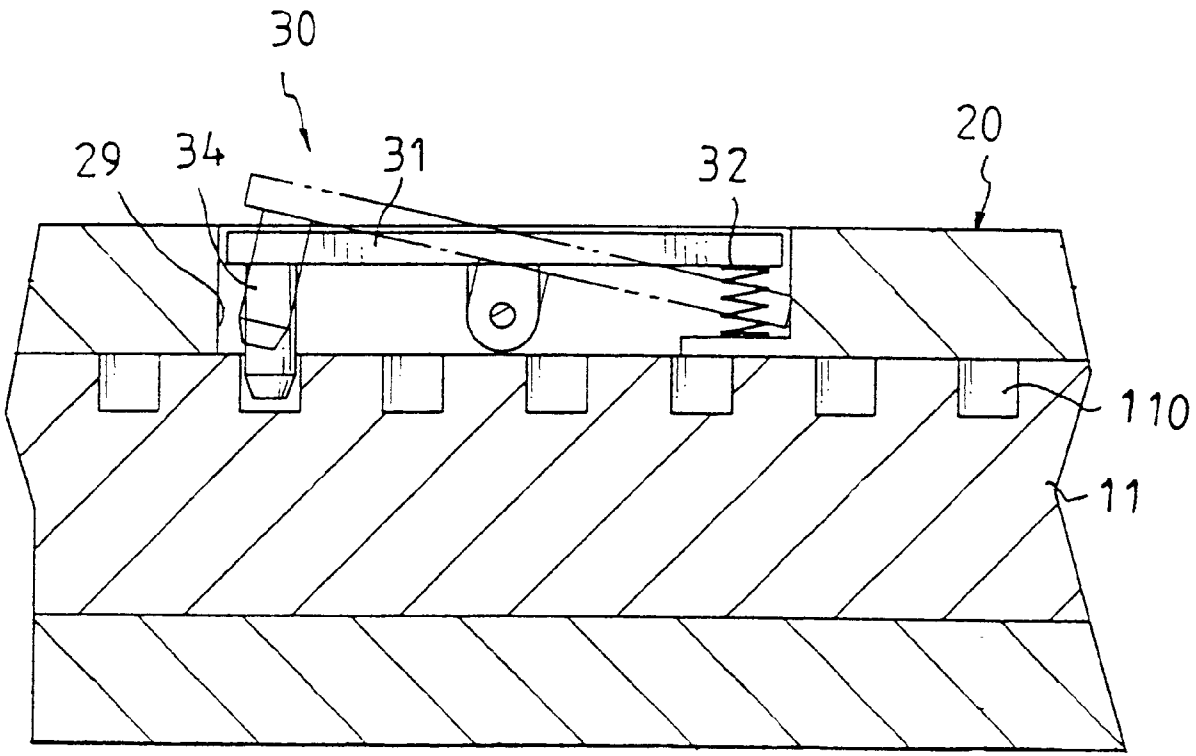
FIG. 18 is a front plan cross-sectional view of the handle structure according to a further embodiment of the present invention.

Referring to FIG. 18, according to a further embodiment of the present invention, the retaining device 30 includes a control member 31 pivotally mounted in the receiving chamber 29 and having a first end and a second end, a positioning block 34 secured on the first end of the control member 31 and detachably received in one of the positioning recesses 110, and a biasing member 32 mounted between the second end of the control member 31 and the wall of the receiving chamber 29.

Figure 19:
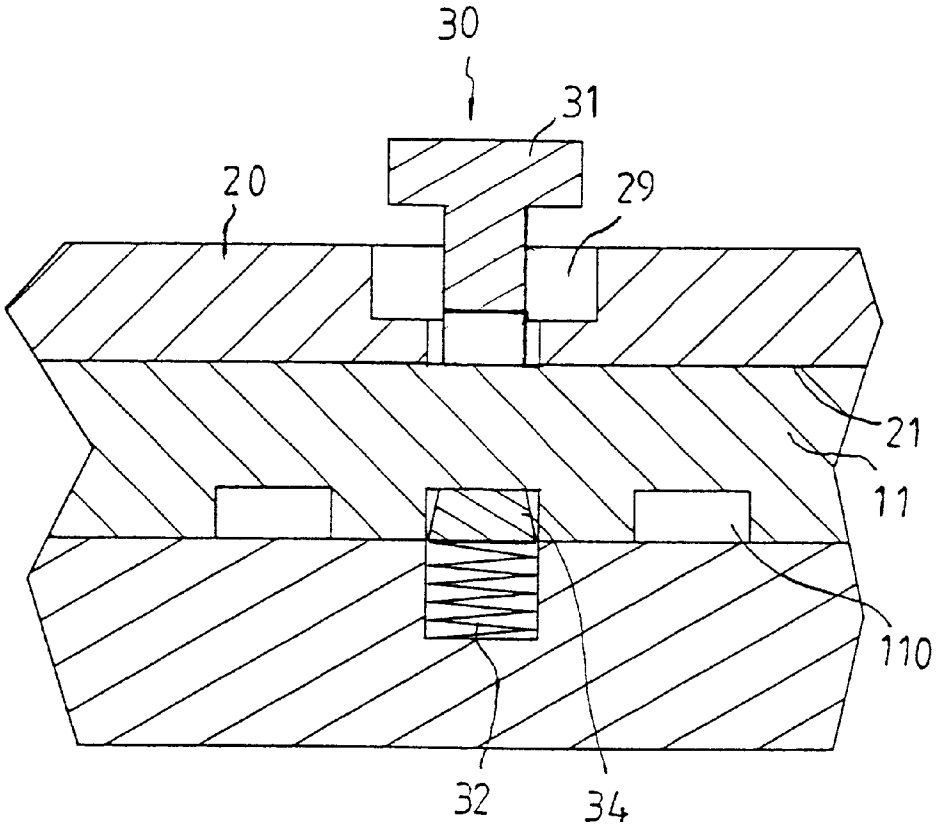
FIG. 19 is a front plan cross-sectional view of the handle structure according to a further embodiment of the present invention.

Referring to FIG. 19, according to a further embodiment of the present invention, the retaining device 30 includes a control member 31 movably mounted in the receiving chamber 29, a positioning block 34 secured on the control member 31 to move therewith and detachably received in one of the positioning recesses 110, and a biasing member 32 mounted between the positioning block 34 and the wall of the receiving chamber 29.

Figure 20:
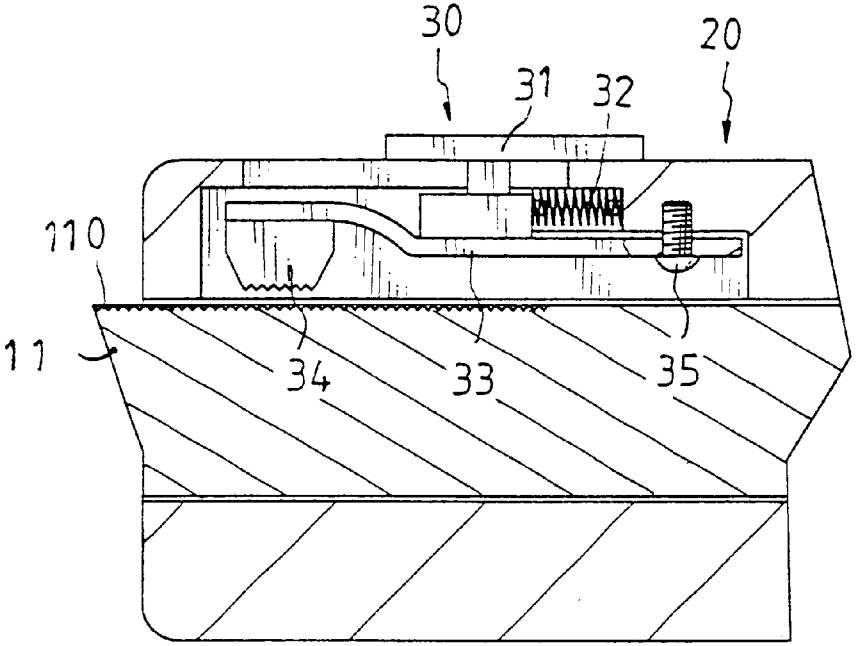
FIG. 20 is a front plan cross-sectional view of the handle structure according to a further embodiment of the present invention.
Figure 21:
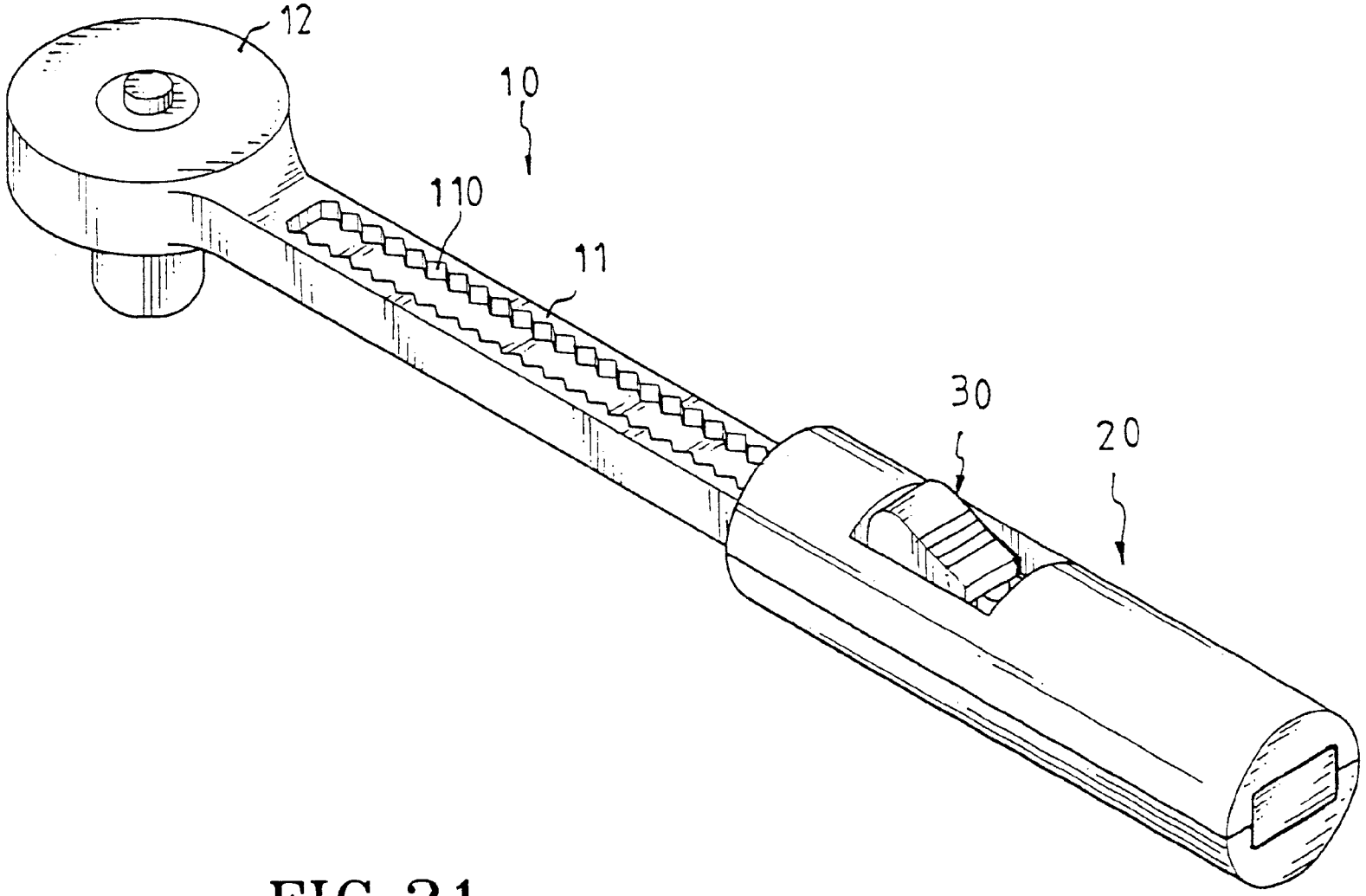
FIG. 21 is a perspective view of the handle structure according to a further embodiment of the present invention.
Figure 22:
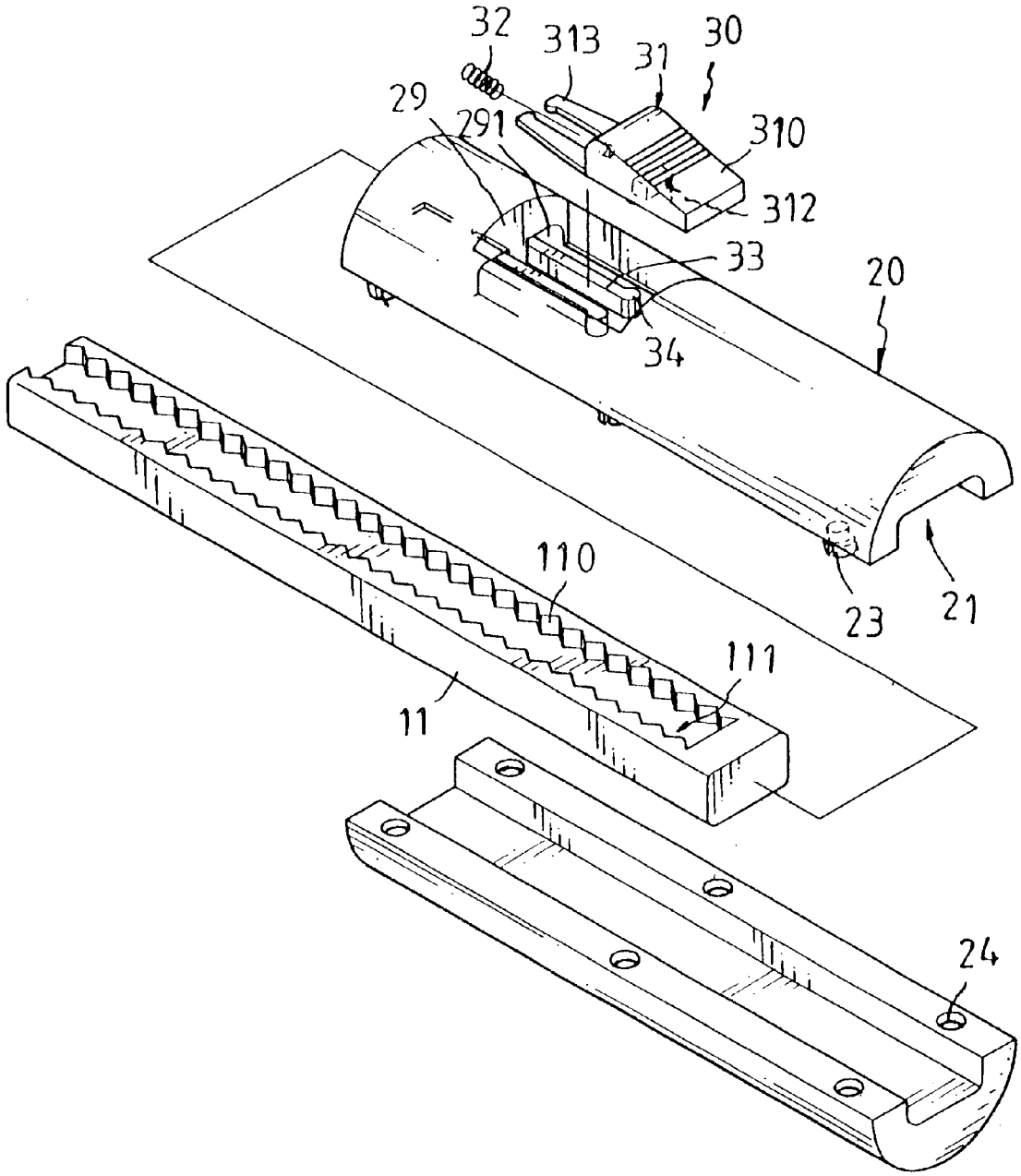
FIG. 22 is an exploded view of the handle structure as shown in FIG. 21.
Figure 23:
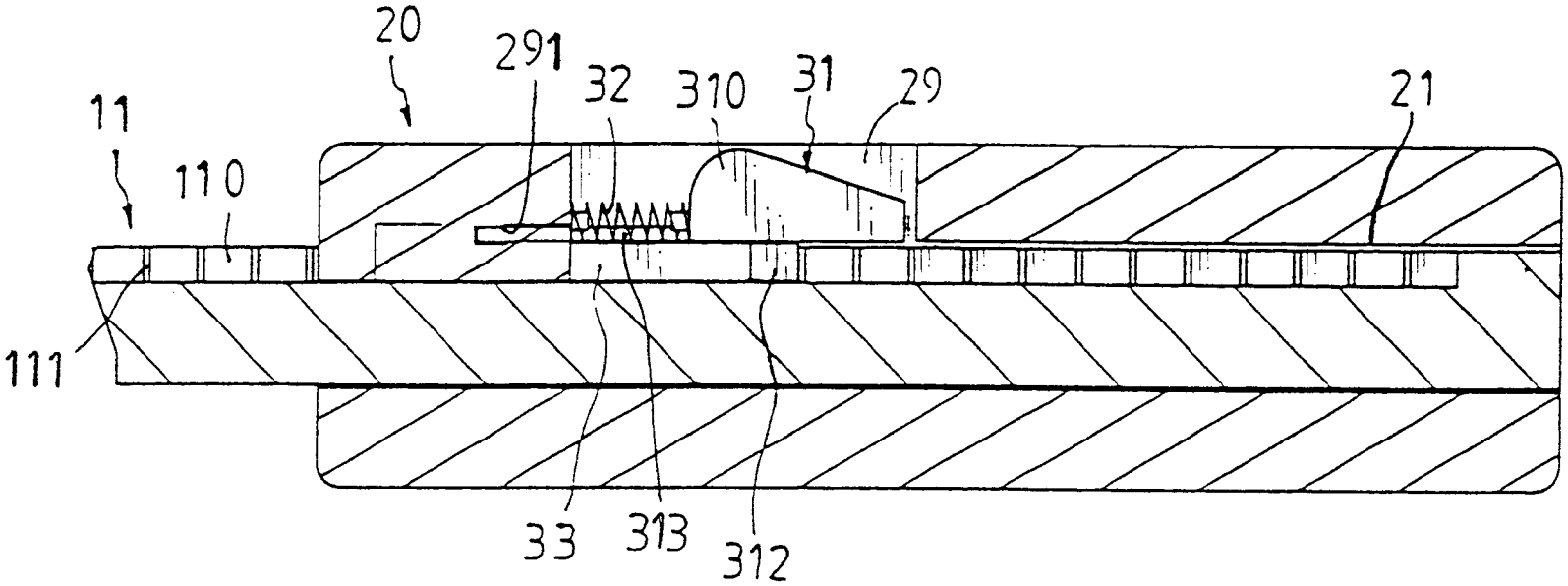
FIG. 23 is a front plan cross-sectional view of the handle structure as shown in FIG. 21.

Referring to FIG. 20, according to a further embodiment of the present invention, the positioning block 34 includes teeth engaged with the positioning teeth 110 of the shank 11 of the tool 10.

Referring to FIGS. 21–24, according to a further embodiment of the present invention, the shank 11 of the tool 10 defines a retaining channel 111 having two sides, and a tooth-shaped positioning portion 110 mounted on each of the two sides of the retaining channel 111. The handle body 20 defines a receiving chamber 29, a guide track 291 defined in the wall of the receiving chamber 29 and connecting to the receiving chamber 29.

The retaining device 30 includes two restoring members 33 each having a first end secured to the wall of the receiving chamber 29 and a second end having a positioning hook 34 detachably engaged with the positioning portion 110 of the shank 11 of the tool 10, and a control member 31 including a pushing portion 310 extending outward from the receiving chamber 29, two slides 313 each secured on the pushing portion 310 to move therewith and slidably received in the guide track 291 of the receiving chamber 29, a pressing block 312 secured on the pushing portion 310 to move therewith and detachably pressed between the two restoring members 33 for pressing the positioning hook 34 of each of the two restoring members 33 to engage with the positioning portion 110 of the shank 11 of the tool 10, and a biasing member 32 mounted between the pushing portion 310 and the wall of the receiving chamber 29.

Figure 24:
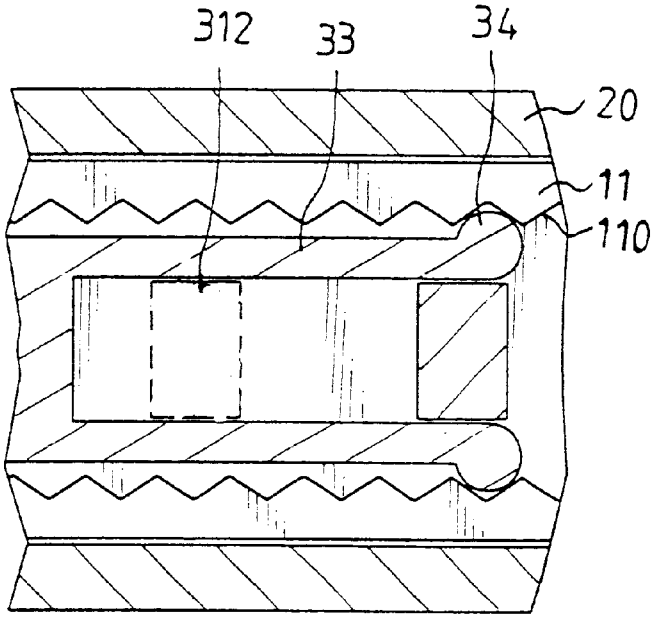
FIG. 24 is a top plan partially enlarged cross-sectional view of the handle structure as shown in FIG. 21.
Figure 25:
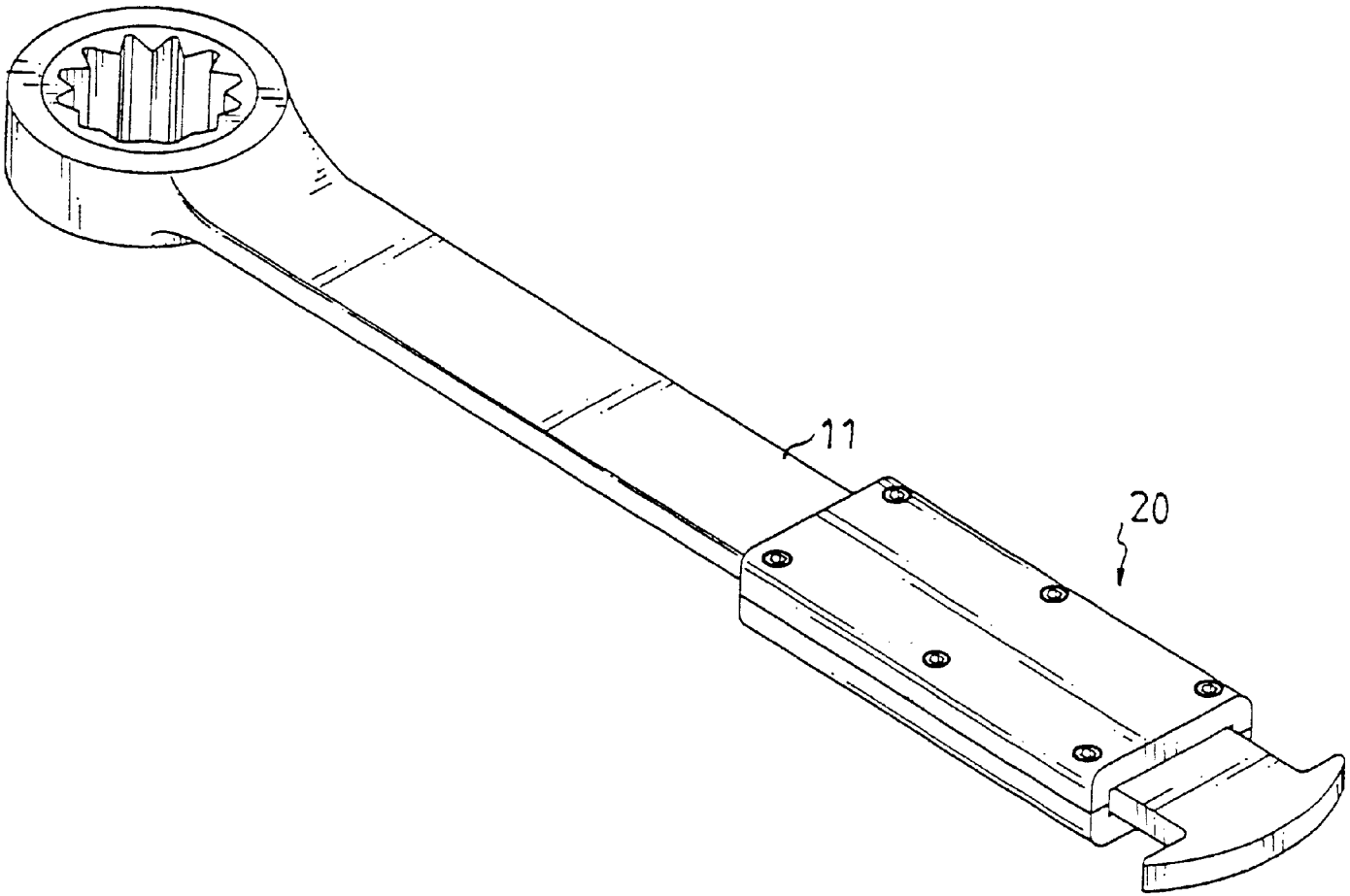
FIG. 25 is a perspective view of the handle structure according to a further embodiment of the present invention.
Figure 26:
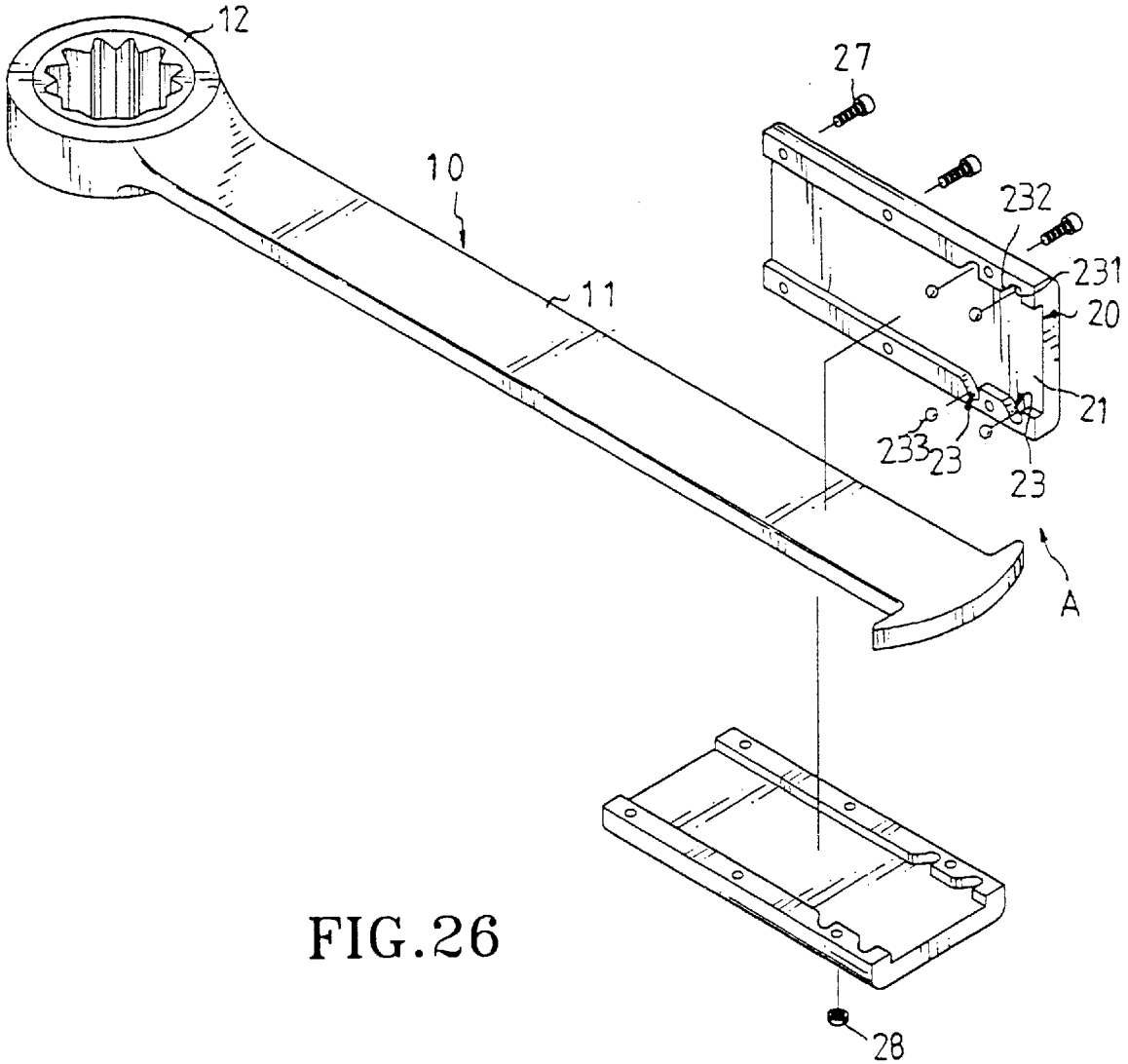
FIG. 26 is an exploded view of the handle structure as shown in FIG. 25.
Figure 27:
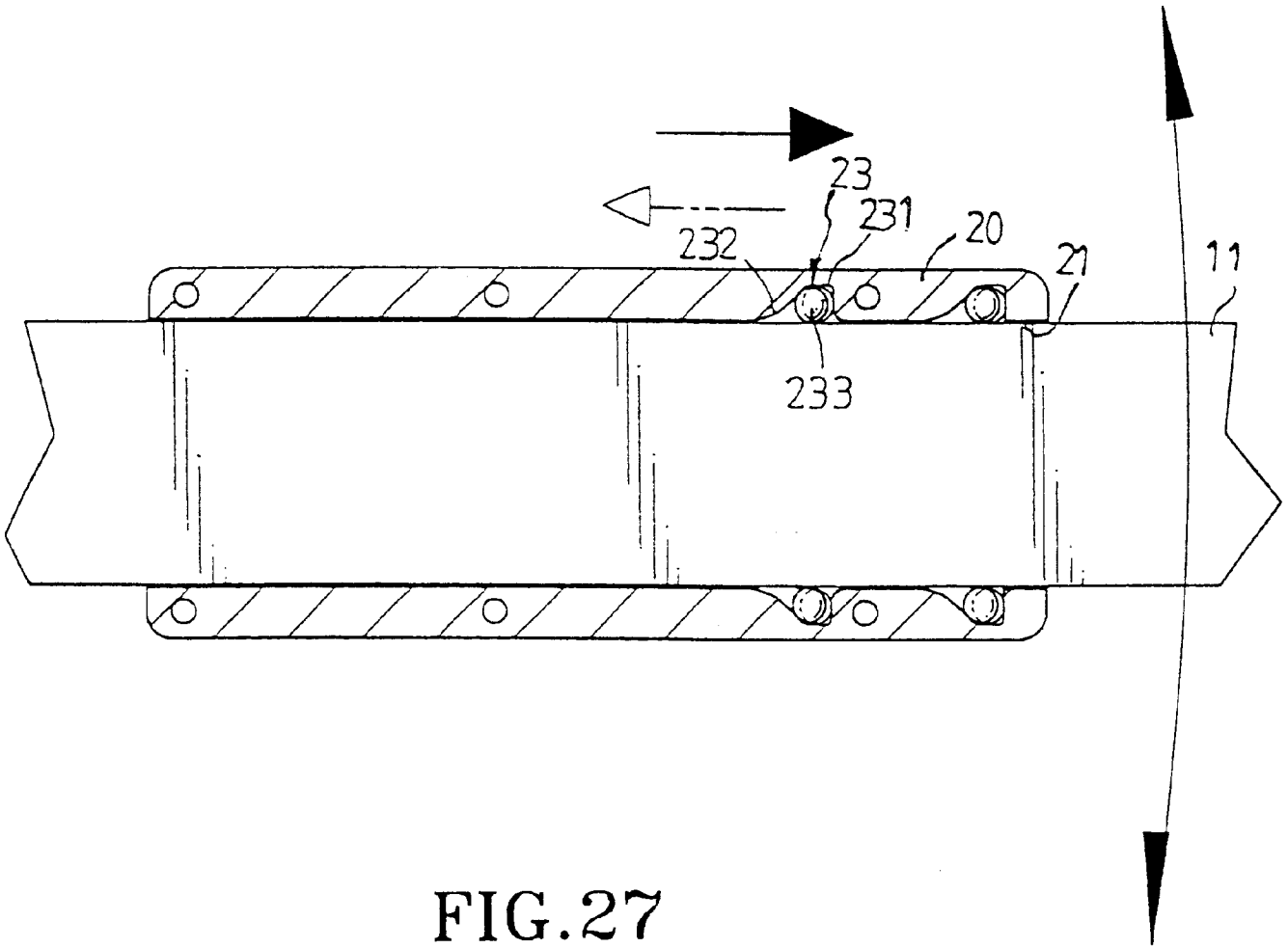
FIG. 27 is a top plan cross-sectional view of the handle structure as shown in FIG. 25.
Figure 28:
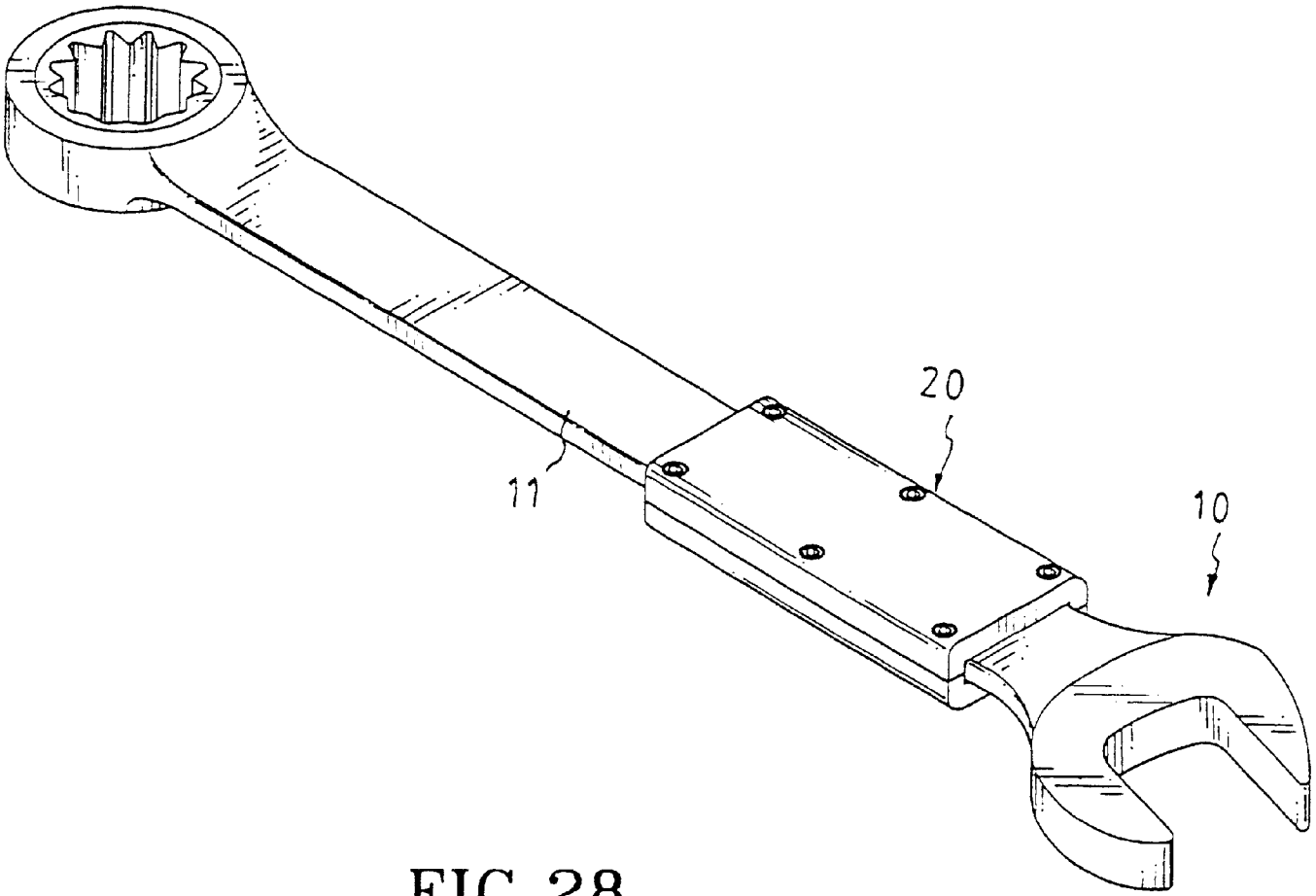
FIG. 28 is a perspective view of the handle structure according to a further embodiment of the present invention.

As shown in FIG. 24, when the pressing block 312 is moved to the position as shown in phantom lines, the positioning hook 34 of each of the two restoring members 33 can be pressed inward to detach from the positioning portion 110 of the shank 11 of the tool 10 so that the handle body 20 can be moved rightward relative to the shank 11 of the tool 10. When the pressing block 312 is moved to the position as shown in solid lines, the positioning hook 34 of each of the two restoring members 33 is retained by the pressing block 312 to engage with the positioning portion 110 of the shank 11 of the tool 10, thereby securing the handle body 20 on the shank 11 of the tool 10.

Referring to FIGS. 25–28, according to a further embodiment of the present invention, the retaining device "A" includes a plurality of anti-slip recesses 23 mounted on each of the two sides of the slide channel 21, and a plurality of stopping balls 233 each received in a corresponding one of the anti-slip recesses 23. Each of the anti-slip recesses 23 has a first side including a vertical surface 231 and a second side including an inclined surface 232.

When the handle body 20 is moved rightward relative to the shank 11 of the tool 10, the stopping ball 233 is moved downward on the inclined surface 232 to press the shank 11 of the tool 10, thereby providing a retaining effect.

Figure 29:
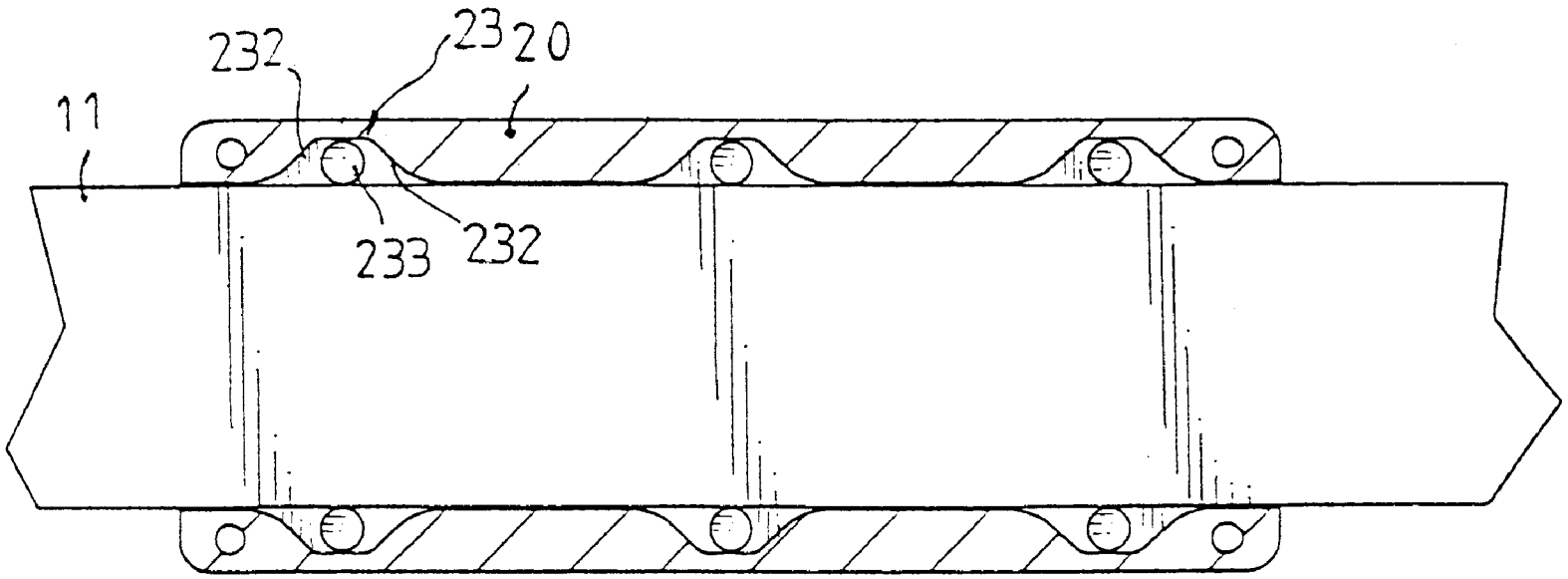
FIG. 29 is a top plan cross-sectional view of the handle structure according to a further embodiment of the present invention.

Referring to FIG. 29, according to a further embodiment of the present invention, each of the anti-slip recesses 23 has two sides each including an inclined surface 232.

Figure 30:
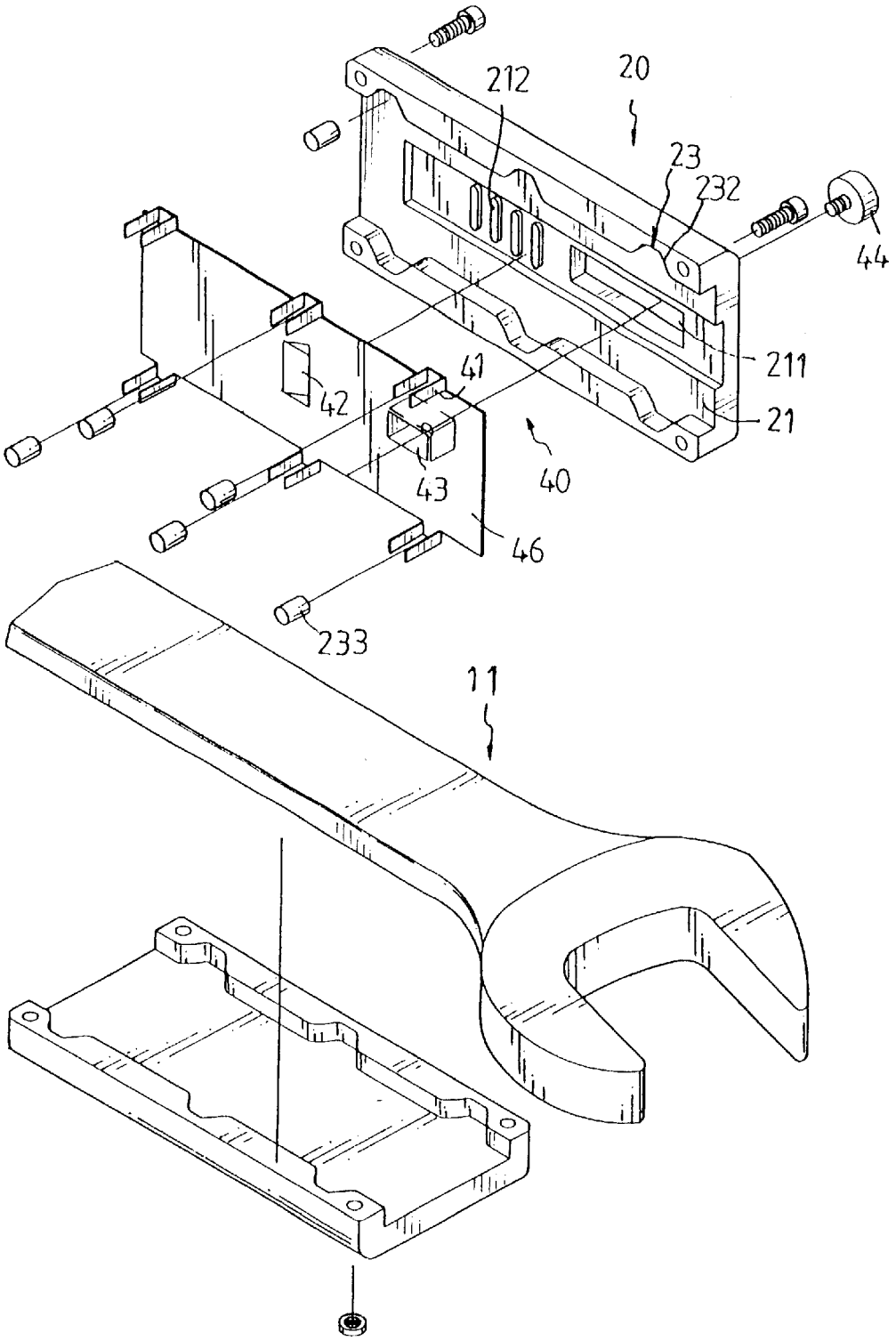
FIG. 30 is an exploded view of the handle structure according to a further embodiment of the present invention.

Referring to FIG. 30, according to a further embodiment of the present invention, the handle body 20 defines a slot 211 connecting to the slide channel 21, and a plurality of nodes 212 mounted in the slide channel 21. The handle structure further comprises a direction changing device 40 mounted between the handle body 20 and the shank 11 of the tool 10.

The direction changing device 40 includes a support plate 46 mounted in the slide channel 21, a limiting portion 43 mounted on the support plate 46 and received in the slot 211, a pushing member 44 secured to the limiting portion 43 and protruding outward from the slot 211, a plurality of holding members 41 mounted on the support plate 46 for holding a corresponding one of the stopping members 233, and an elastic hook-shaped locking member 42 mounted on the support plate 46 and detachably engaging with the nodes 212.

Figure 31:
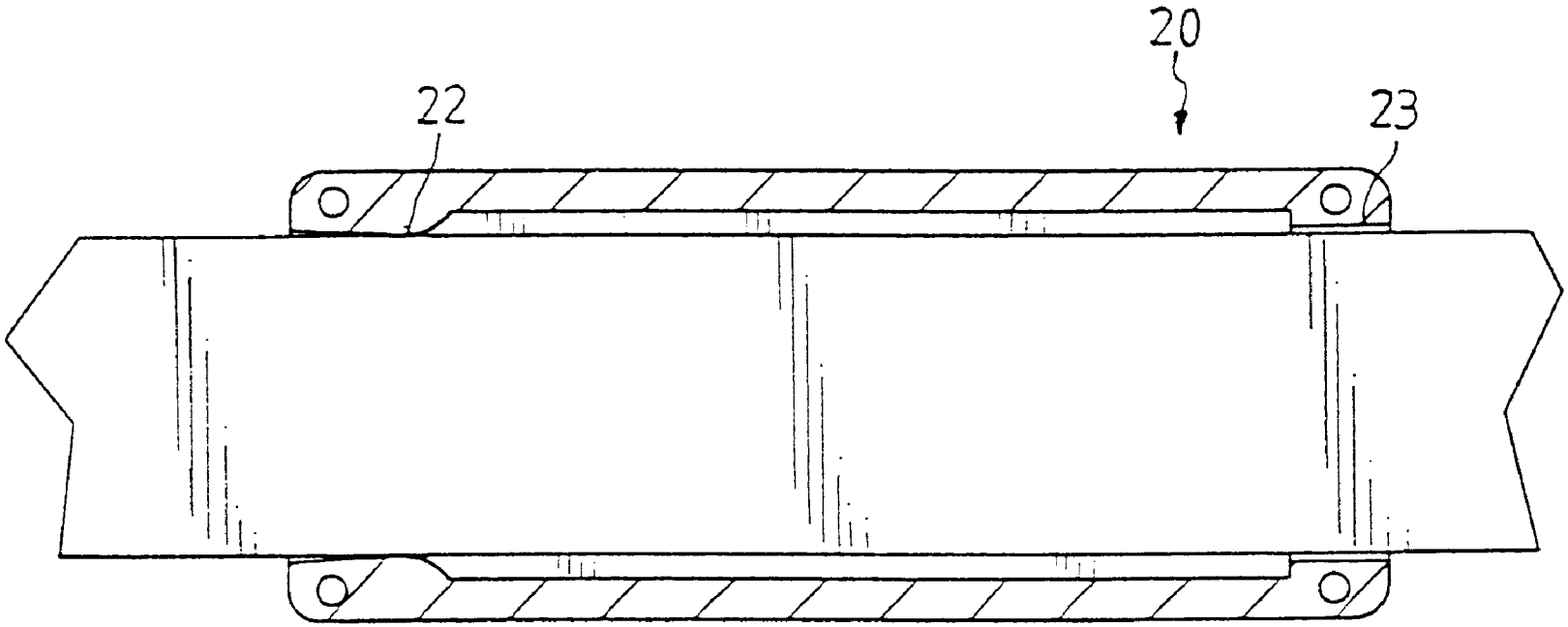
FIG. 31 is a top plan cross-sectional view of the handle structure according to a further embodiment of the present invention.
Figure 32:
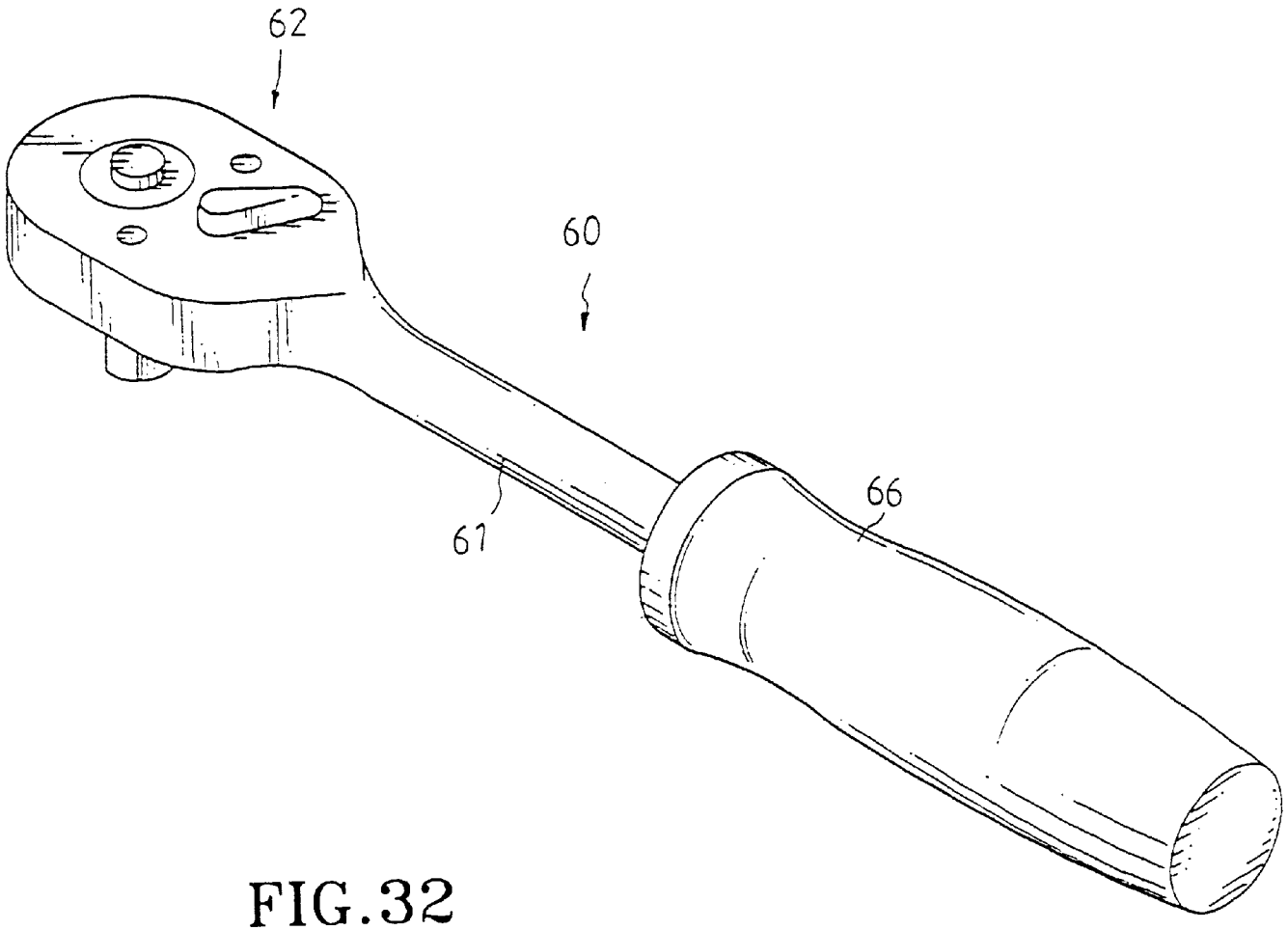
FIG. 32 PRIOR ART
FIG. 32 is a perspective view of a first conventional tool according to the prior art.
Figure 33:
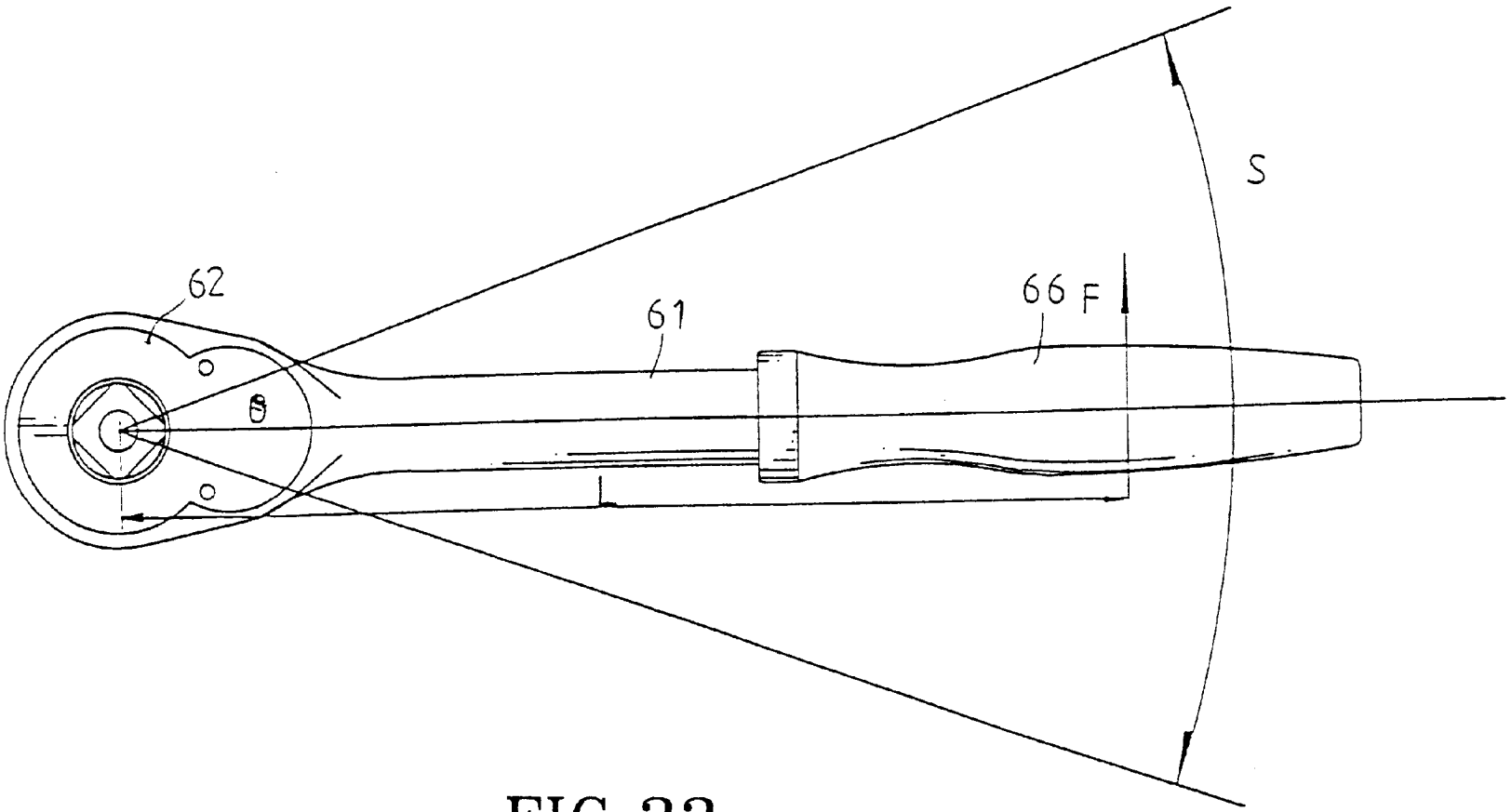
FIG. 33 PRIOR ART
FIG. 33 is a top plan view of the first conventional tool as shown in FIG. 32.
Figure 34:
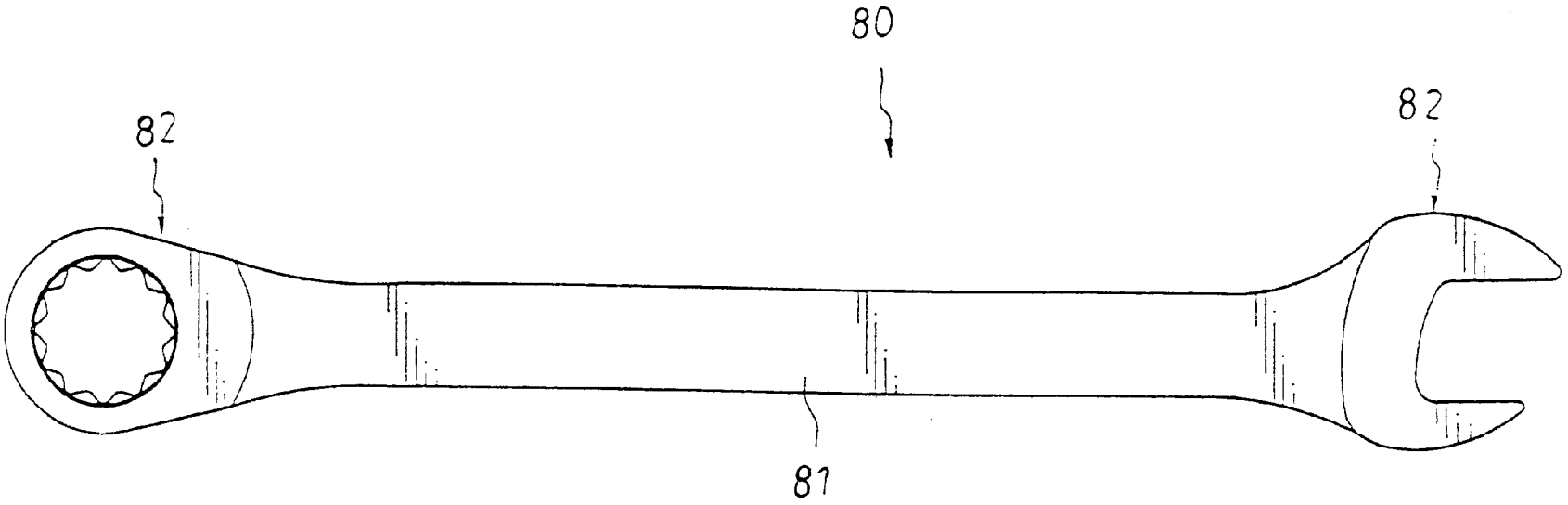
FIG. 34 PRIOR ART
FIG. 34 is a top plan view of a second conventional tool according to the prior art.
Figure 35:
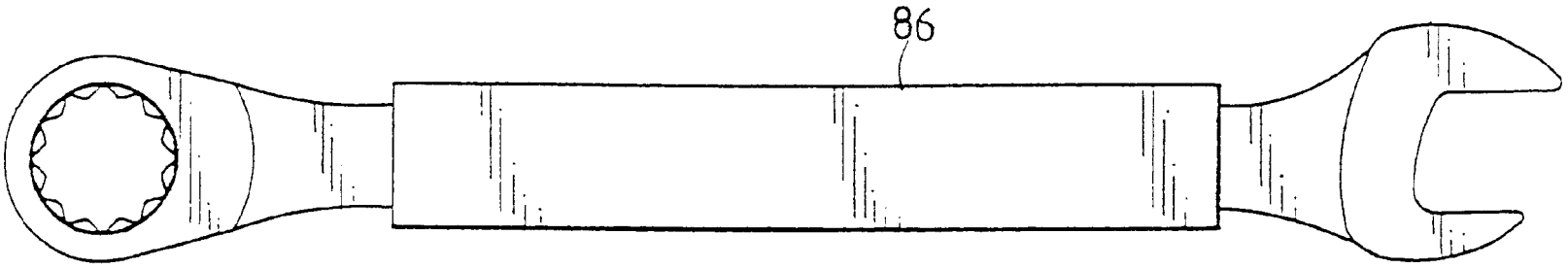
FIG. 35 PRIOR ART
FIG. 35 is a top plan view of the second conventional tool as shown in FIG. 34.

Referring to FIG. 31, according to a further embodiment of the present invention, the receiving recess 24 and the positioning teeth 230 are undefined, and the support portion 22 is inclined relative to the anti-slip member 23.

It should be clear to those skilled in the art that further embodiments may be made without departing from the scope of the present invention.

What is claimed is:

1. A handle structure in combination with a tool, said tool (10) including a shank (11), said handle structure comprising:

a handle body (20) slidably secured on said shank (11) of said tool (10) for adjusting an arm of force of said shank (11) of said tool (10), said handle body (20) defining a slide channel (21) for receiving said shank (11) of said tool (10); and a retaining device (30) mounted between said handle body (20) and said shank (11) of said tool (10) for retaining said handle body (20) on said shank (11) of said tool (10); wherein:

said shank (11) of said tool (10) includes a plurality of positioning portions (110), said handle body (20) defines a receiving chamber (29) having two sides each including a pressing edge (290), and said retaining device (30) includes a restoring member (33) having a first end secured to a wall of said receiving chamber (29) and a bent second end (330), a positioning block (34) secured on said second end (330) of said restoring member (33) and detachably engaged with said positioning portions (110), and a control member (31) including a pushing plate (310) extending outward from said receiving chamber (29), a slide (311) mounted on said pushing plate (310) and slidably mounted against said pressing edge (290) of said receiving chamber (29), a pressing block (312) mounted on said slide (311) for pressing said second end (330) of said restoring member (33), and a biasing member (32) mounted between said pressing block (312) and a second wall of said receiving chamber (29).

2. The handle structure in accordance with claim 1, wherein said handle body (20) includes two half bodies (26) coupled with each other, and said handle structure further comprises a locking device (24) for securing said two half bodies (26) together and including a plurality of locking bores (241) defined in a first one of said two half bodies (26) of said handle body (20), and a plurality of snapping stubs (240) mounted on a second one of said two half bodies (26) of said handle body (20) and each snapped into a corresponding one of said locking bores (241).

3. The handle structure in accordance with claim 1, wherein said handle body (20) has one distal end defining a limiting recess (210), and said shank (11) of said tool (10) has one distal end including an enlarged head (112) detachably received in said limiting recess (210).

* * * * *